US008690625B2

(12) United States Patent
Kato et al.

(10) Patent No.: US 8,690,625 B2
(45) Date of Patent: Apr. 8, 2014

(54) OUTBOARD MOTOR AND WATERCRAFT INCLUDING THE SAME

(71) Applicant: Yamaha Hatsudoki Kabushiki Kaisha, Iwata (JP)

(72) Inventors: Shuji Kato, Shizuoka (JP); Atsushi Suzuki, Shizuoka (JP); Daisuke Takasu, Shizuoka (JP); Satoshi Miyazaki, Shizuoka (JP); Yusuke Takahashi, Shizuoka (JP); Makoto Kuroiwa, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 13/713,202

(22) Filed: Dec. 13, 2012

(65) Prior Publication Data

US 2013/0157533 A1 Jun. 20, 2013

(30) Foreign Application Priority Data

Dec. 14, 2011 (JP) ..... 2011-273782

(51) Int. Cl.
*F01N 3/04* (2006.01)

(52) U.S. Cl.
USPC ..... 440/89 H

(58) Field of Classification Search
USPC ..... 440/88 F, 89 H
See application file for complete search history.

(56) References Cited

U.S. PATENT DOCUMENTS

| | | | | |
|---|---|---|---|---|
| 5,438,963 | A * | 8/1995 | Tsunoda et al. | 123/54.4 |
| 5,494,467 | A * | 2/1996 | Sohgawa et al. | 440/89 R |
| 5,617,821 | A * | 4/1997 | Tsunoda et al. | 123/195 P |
| 6,729,921 | B1 * | 5/2004 | Ishii | 440/89 H |
| 8,002,597 | B2 * | 8/2011 | Ochiai | 440/89 H |

FOREIGN PATENT DOCUMENTS

JP 06-159053 A 6/1994

OTHER PUBLICATIONS

Takano et al, "Outboard Motor and Watercraft Including the Same", U.S. Appl. No. 13/713,222, filed Dec. 13, 2012.
Suzuki et al, "Outboard Motor and Watercraft Including the Same", U.S. Appl. No. 13/713,213, filed Dec. 13, 2012.

* cited by examiner

*Primary Examiner* — Stephen Avila
(74) *Attorney, Agent, or Firm* — Keating & Bennett, LLP

(57) ABSTRACT

An outboard motor includes a left bank and a right bank. An exhaust port in each of the left bank and the right bank is arranged outward relative to a cylinder axis line in an outer motor width direction. A left exhaust pipe is arranged outward relative to a crankcase and the left bank in the outer motor width direction. A right exhaust pipe is arranged outward relative to the crankcase and the right bank in the outer motor width direction. A catalyst is located in each of the left and right exhaust pipes.

18 Claims, 36 Drawing Sheets

OUTBOARD MOTOR AND WATERCRAFT INCLUDING THE SAME

CROSS-REFERENCES TO RELATED APPLICATIONS

The present application claims priority from Japanese Patent Application No. 2011-273782, filed on Dec. 14, 2011, which is incorporated by reference herein in its entirety.

BACKGROUND OF THE INVENTION

1. Field of the Invention

The present invention relates to an outboard motor and a watercraft including the same, and specifically to an outboard motor including a V-shaped 4-cycle engine which includes a catalyst to purify exhaust gas, and a watercraft including such an outboard motor.

2. Description of the Related Art

An engine of an outboard motor is generally structured to discharge exhaust gas into water. However, the exhaust gas, if discharged as it is, causes air pollution. Thus, a catalyst for purifying exhaust gas is provided in the engine of the outboard motor.

JP 6-159053 describes a V-shaped 2-cycle engine including a left bank extending in an obliquely rearward and leftward direction and a right bank extending in an obliquely rearward and rightward direction and also having a catalyst located to the left of the left bank and also to the right of the right bank. In more detail, an exhaust case having a path extending downward is formed to the left of the left bank and also to the right of the right bank. The catalyst is accommodated in each of the exhaust cases.

In the left bank, an exhaust port open in an obliquely rearward and rightward direction is formed. An exhaust pipe connected to the exhaust port once extends upward, passes above the left bank, and is connected to the exhaust case located to the left of the left bank. In the right bank, an exhaust port open in an obliquely rearward and leftward direction is formed. An exhaust pipe connected to the exhaust port once extends upward, passes above the right bank, and is connected to the exhaust case located to the right of the right bank.

In the above-described V-shaped engine, the exhaust pipes in the left bank and the right bank are both formed to pass above the respective banks, and therefore are long. In the above-described V-shaped engine, a large space is occupied by the exhaust pipes, which prevents a decrease in the size of the outboard motor.

SUMMARY OF THE INVENTION

Preferred embodiments of the present invention provide a compact outboard motor including a V-shaped engine including a catalyst that purifies exhaust gas, and a watercraft including such an outboard motor.

An outboard motor according to a preferred embodiment of the present invention includes a V-shaped 4-cycle engine including a crankshaft extending in a vertical direction; a left bank which includes a cylinder including a cylinder axis line extending in an obliquely rearward and leftward direction, and extends in an obliquely rearward and leftward direction; and a right bank which includes a cylinder including a cylinder axis line extending in an obliquely rearward and rightward direction, and extends in an obliquely rearward and rightward direction. The left bank and the right bank each include a cylinder block including the cylinder provided therein; and a cylinder head secured to the cylinder block so as to cover the cylinder along the cylinder axis line and defining a combustion chamber together with the cylinder. The cylinder head includes an intake port arranged inward relative to the cylinder axis line in an outboard motor width direction and in communication with the combustion chamber and also includes an exhaust port arranged outward relative to the cylinder axis line in the outboard motor width direction and in communication with the combustion chamber. The outboard motor further includes a crankcase including the crankshaft accommodated therein; a left exhaust path arranged outward relative to the crankcase and the left bank in the outboard motor width direction and in communication with the exhaust port in the left bank; a right exhaust path arranged outward relative to the crankcase and the right bank in the outboard motor width direction and in communication with the exhaust port in the right bank; a catalyst located inside the left exhaust path; and a catalyst located inside the right exhaust path.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 9 is a vertical cross-sectional view of a surge tank and the like.

FIG. 11 is a left side view of an exhaust manifold, an exhaust pipe and the like.

FIG. 17 is a partial rear view showing the high-pressure fuel pump, a fuel supply rail, a fuel injection device and the like.

FIG. 18 is a perspective view of a fuel pipe, the fuel supply rail and the like.

DETAILED DESCRIPTION OF THE PREFERRED EMBODIMENTS

Figure 1:
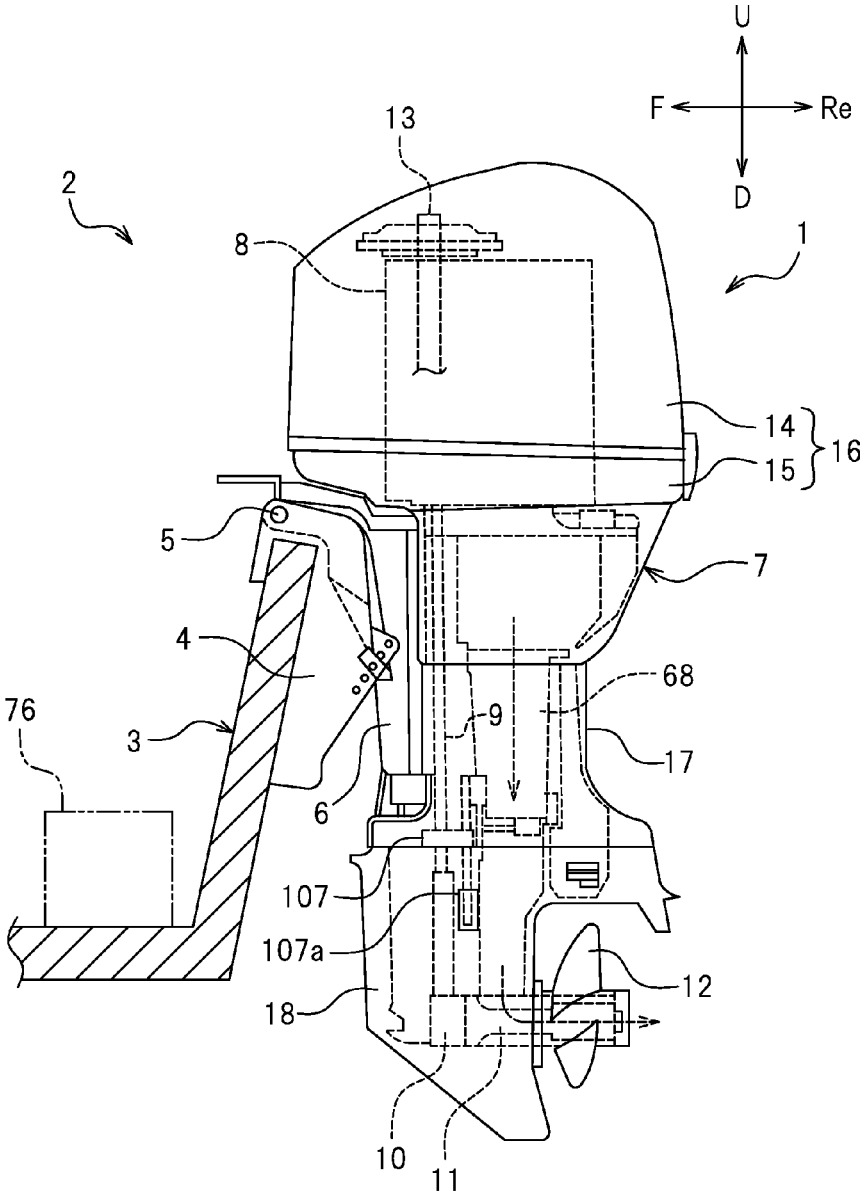
FIG. 1 is a side view of a portion of a hull and an outboard motor.

As shown in FIG. 1, a watercraft 2 includes a hull 3 and an outboard motor 1 attached to a rear portion of the hull 3. In the following description, the terms "front", "rear", "left" and "right" respectively refer to front, rear, left and right with respect to the travelling direction of the watercraft 2 unless otherwise specified. In the figures, reference signs, F, Re, L and R (see FIG. 2 and the like) respectively represent front, rear, left and right. Reference signs U and D respectively represent up and down. The outboard motor 1 includes a clamp bracket 4 secured to the rear portion of the hull 3, a swivel bracket 6 swingably coupled to the clamp bracket 4 via a tilt shaft 5, and an outboard motor main body 7 secured to the swivel bracket 6.

Inside the swivel bracket 6, a swivel shaft (not shown) extending in a vertical direction is provided. The outboard motor main body 7 is rotatable about the swivel shaft. By rotating the outboard motor main body 7 about the swivel shaft, the orientation of the outboard motor main body 7 can be changed to obliquely leftward or to obliquely rightward. The outboard motor main body 7 is swingable leftward and rightward about the swivel shaft. A swing of the swivel bracket 6 about the tilt shaft 5 allows the outboard motor main body 7 to swing about the tilt shaft 5 together with the swivel bracket 6. As can be seen, the outboard motor main body 7 is swingable about a vertical axis and also swingable about a horizontal axis.

The outboard motor main body 7 includes an engine 8, a drive shaft 9 extending downward from the engine 8, a switch mechanism 10 arranged to switch the movement of the outboard motor 1 between a forward movement and a rearward movement, a propeller shaft 11, and a propeller 12 secured to a tip of the propeller shaft 11. The engine 8 includes a crankshaft 13 extending in the vertical direction. Herein, the term "vertical" encompasses the vertical direction in a narrow sense and also a direction slightly inclined from the vertical direction. More specifically, the term "vertical" encompasses a substantially vertical direction. A bottom end portion of the crankshaft 13 is coupled to a top end portion of the drive shaft 9. A bottom end portion of the drive shaft 9 is coupled to a front end portion of the propeller shaft 11 via the switch mechanism 10.

The outboard motor 1 includes, as a housing to cover the engine 8 and the like, a cowling 16 including a top cowl 14 and a bottom cowl 15, an upper case 17 connected to a bottom portion of the cowling 16, and a lower case 18 connected to a bottom portion of the upper case 17. The engine 8 is accommodated in the cowling 16. The cowling may be referred to as an "engine cover".

When the engine 8 is driven, the crankshaft 13 is rotated. Along with the rotation of the crankshaft 13, the drive shaft 9 is rotated. A driving force of the drive shaft 9 is transmitted to the propeller shaft 11 via the switch mechanism 10. Along with the rotation of the drive shaft 9, the propeller shaft 11 is rotated. When the propeller shaft 11 is rotated, the propeller 12 is rotated and thus a thrust is generated. The propeller shaft 11 and the propeller 12 are rotatable in both of two directions. The rotation direction of the propeller shaft 11 and the propeller 12 is switched by the switch mechanism 10. When rotating in one direction, the propeller 12 generates a forward (i.e., leftward in FIG. 1) thrust. When rotating in the other direction, the propeller 12 generates a rearward (i.e., rightward in FIG. 1) thrust.

Figure 2:
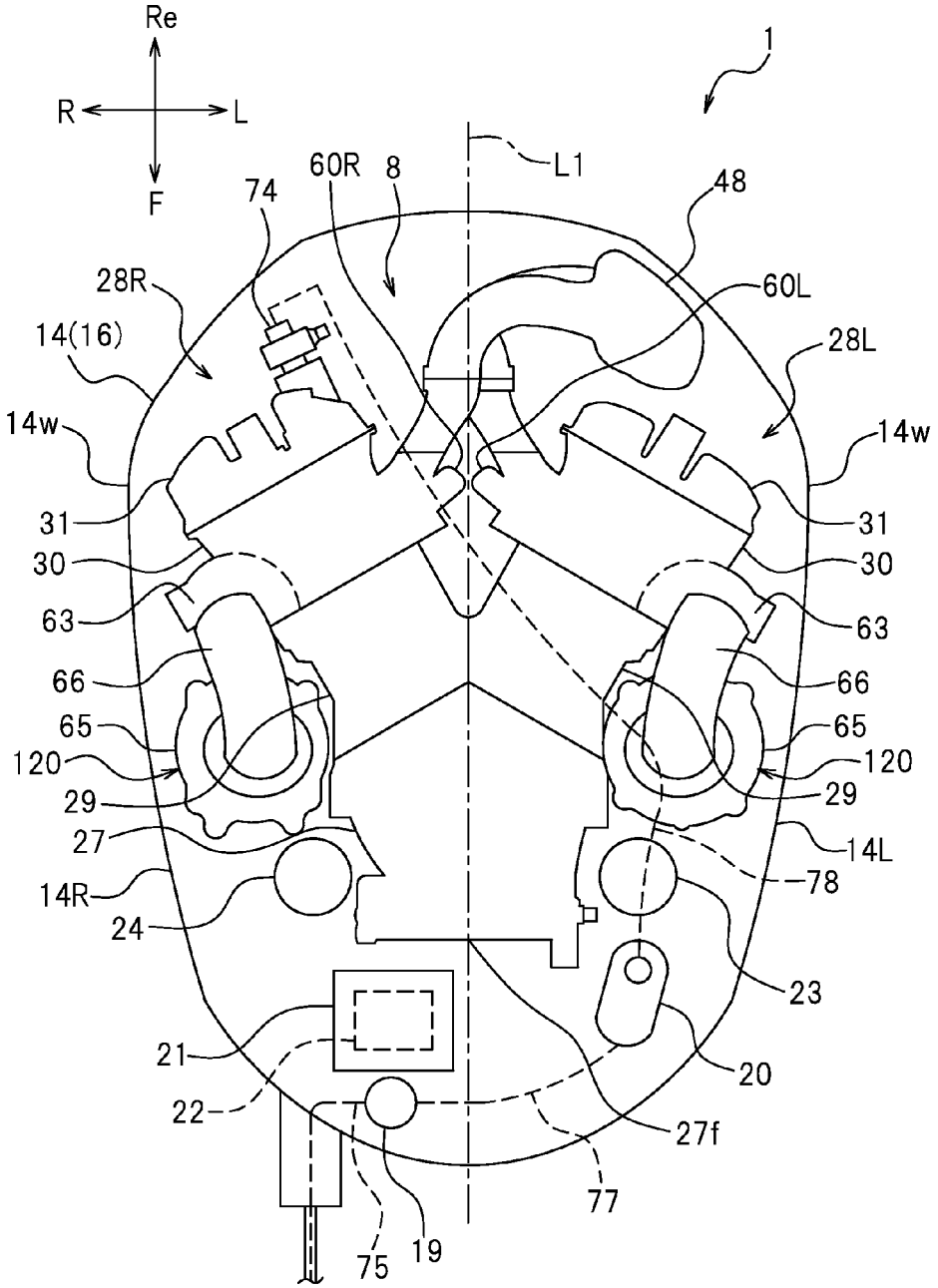
FIG. 2 is a plan view conceptually showing an internal structure of the outboard motor.
Figure 3:
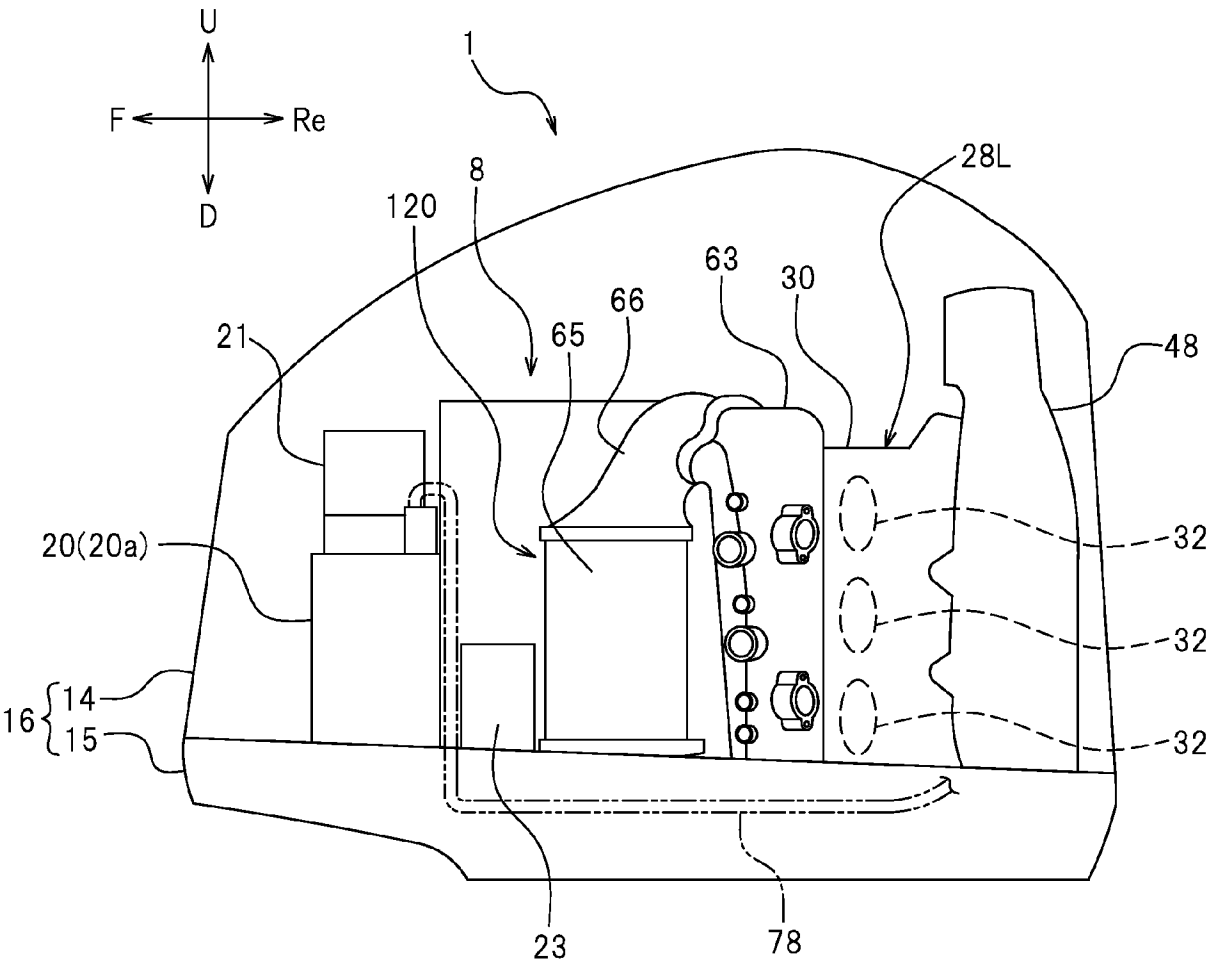
FIG. 3 is a left side view of a portion of the outboard motor.
Figure 4:
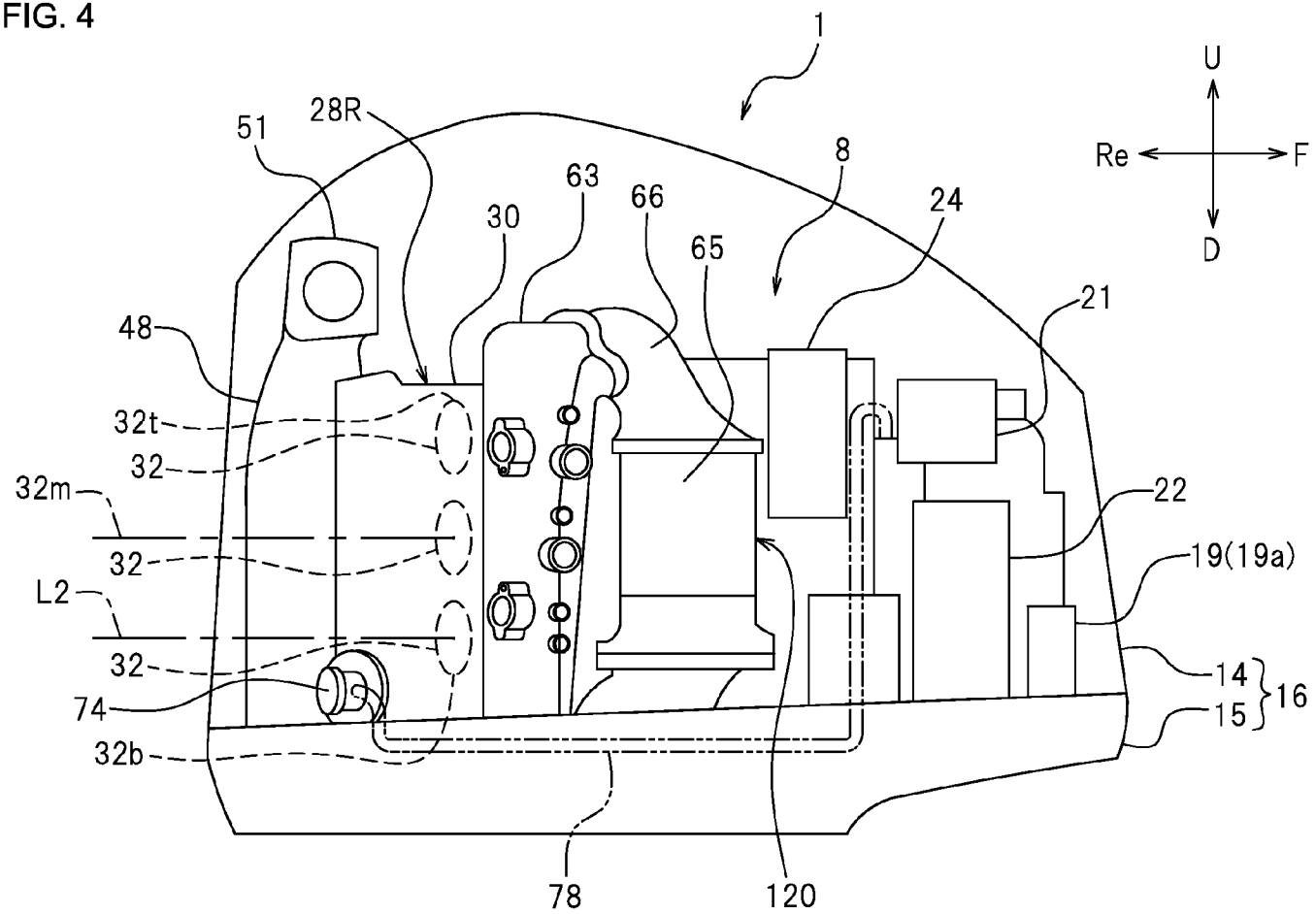
FIG. 4 is a right side view of a portion of the outboard motor.
Figure 5:
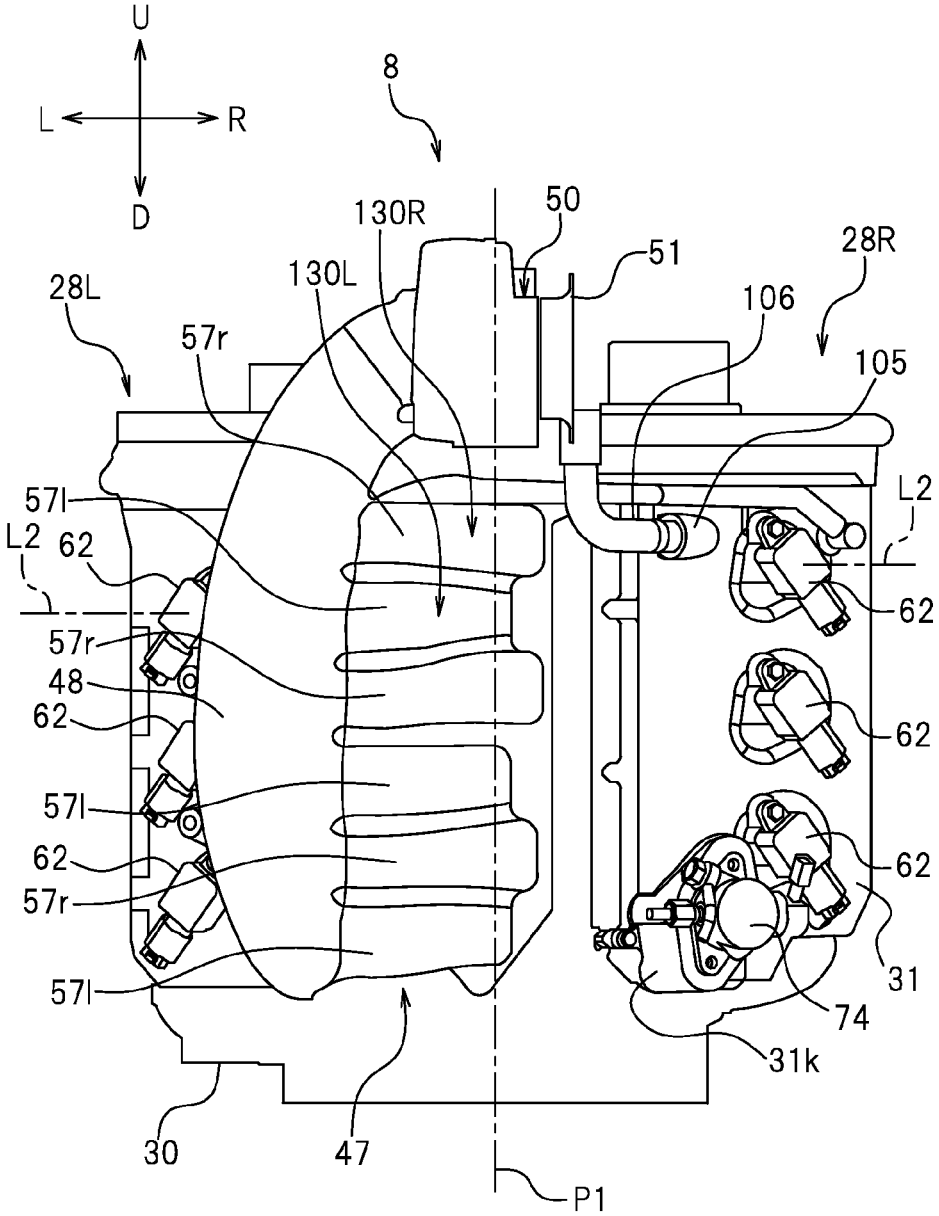
FIG. 5 is a rear view of an engine.

FIG. 2 is a schematic plan view showing an internal structure of the cowling 16. FIG. 3 is a schematic left side view showing an internal structure of the cowling 16, and FIG. 4 is a schematic right side view thereof. FIG. 5 is a rear view of the engine 8. In FIG. 2, line L1 represents a center line of the engine 8. The center line L1 passes a center 13*a* (see FIG. 6) of the crankshaft 13, and is defined as a straight line extending in the front-rear direction. The center line L1 is also referred to as the center line of the outboard motor 1. In the following description, the expression "inward in the outboard motor width direction" refers to a position closer to the center line L1 of the outboard motor 1, and the expression "outward in the outboard motor width direction" refers to a position farther from the center line L1 of the outboard motor 1. In this preferred embodiment, the "outboard motor width direction" refers to the left-right direction.

As shown in FIG. 2, the top cowl 14 of the cowling 16 is preferably arranged to be bilaterally symmetric with respect to the center line L1. The top cowl 14 preferably has a width that first increases from a front end and then decreases toward a rear end. The top cowl 14 preferably has a substantially egg-shaped profile. A portion where the width is maximum (hereinafter, referred to as a "maximum portion") 14*w* is located rearward of the center position in the front-rear direction. The maximum portion 14*w* is located at a position which is forward with respect to the rear end thereof by about ¼ of the entire length of the top cowl 14. The rear end and the entire length of the top cowl 14 are respectively the rear end and the entire length of the cowling 16.

As described later in detail, the outboard motor 1 includes an intake system arranged to supply air to the engine 8, an exhaust system arranged to discharge the exhaust gas from the engine 8, a fuel supply system arranged to supply fuel to the engine 8, and a cooling system arranged to supply cooling water to the engine 8. As shown in FIG. 5, the intake system includes a throttle body 50 including a throttle valve accommodated therein, a surge tank 48 to which air is supplied from the throttle body 50, and an intake manifold 47 arranged to distribute the air to each of combustion chambers of the engine 8 from the surge tank 48. As shown in FIG. 3, the exhaust system includes an exhaust manifold 63 arranged to join the exhaust gas from the combustion chambers, and an exhaust pipe 120 including a catalyst accommodated therein. As shown in FIG. 2, the fuel supply system includes a fuel filter 19, a vapor separator tank 20, and a high-pressure fuel pump 74. The cooling system includes a water pump 107 (see FIG. 1) and water jackets included in the engine 8 and the like.

As shown in FIG. 2, the cowling 16 also accommodates other components such as a fuse box 21, an ECU (Engine Control Unit) 22 (see FIG. 4), an oil filter 23, a starter motor 24 and the like accommodated therein.

The engine 8 preferably is a water-cooled V-shaped multi-cylinder engine, for example. In this preferred embodiment, the engine 8 preferably is a V-shaped 6-cylinder engine, for example. The type of engine according to the present invention is not limited however, and the number of cylinders of the engine according to the present invention is not limited to 6.

Figure 6:
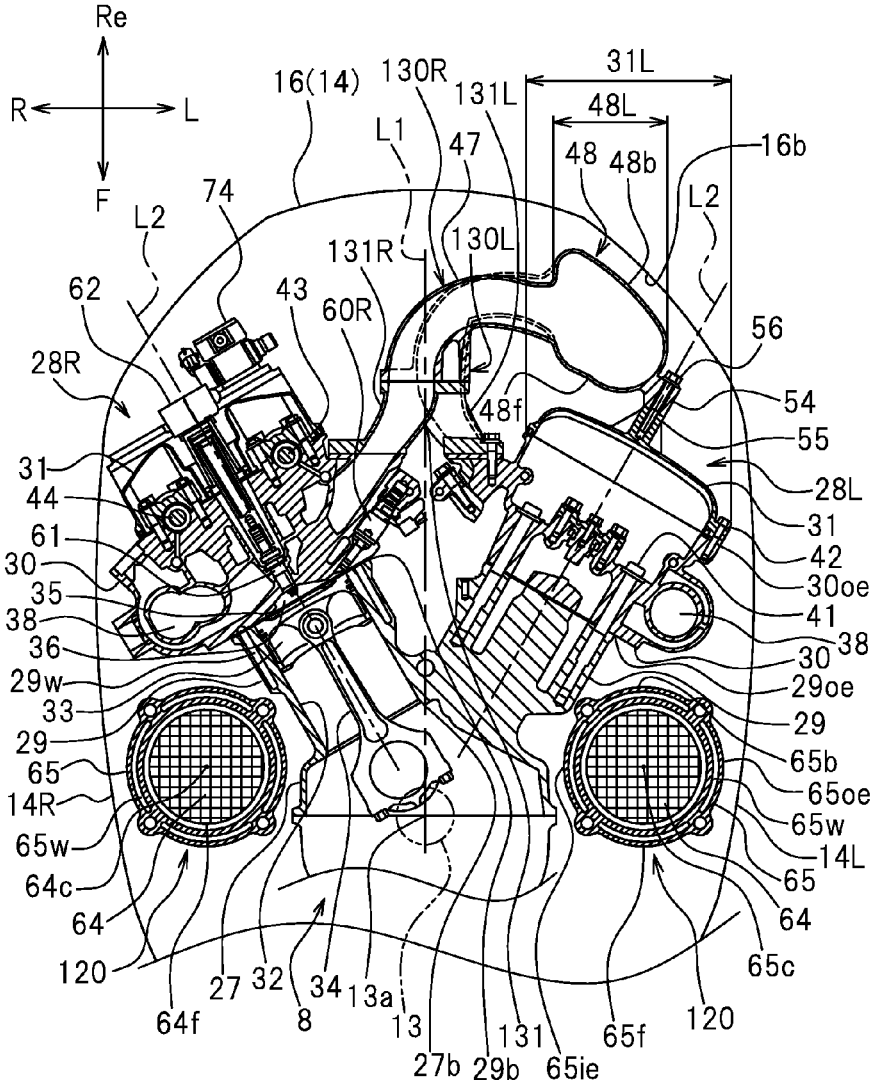
FIG. 6 is a horizontal cross-sectional view of a portion of the engine.

As shown in FIG. 6, the engine 8 includes a crankcase 27, a left bank 28L extending in an obliquely rearward and leftward direction, and a right bank 28R extending in an obliquely rearward and rightward direction. The left bank 28L and the right bank 28R each include a cylinder block 29 including cylinders 32 provided therein, a cylinder head 30 linked to the cylinder block 29 so as to cover the cylinders 32, and a head cover 31 arranged cover a tip portion of the cylinder head 30.

Figure 7:
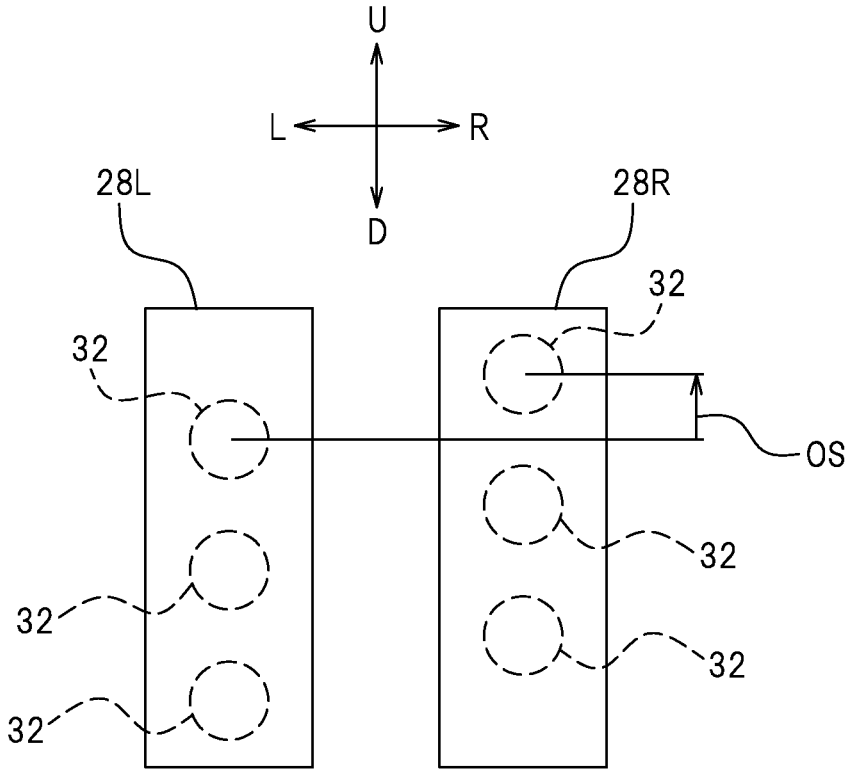
FIG. 7 is a conceptual view provided for explaining how cylinders are offset.

As schematically shown in FIG. 7, the left bank 28L and the right bank 28R each include three cylinders 32, for example, arranged in the vertical direction. The cylinders 32 in the left bank 28L and the cylinders 32 in the right bank 28R are located alternately in the up-down direction. The three cylinders 32 in each of the left bank 28L and the right bank 28R are referred to as the lowermost cylinder 32, the middle cylinder 32 and the uppermost cylinder 32 sequentially from the bottom. The lowermost cylinder 32 in the left bank 28L is located at a position lower than that of the lowermost cylinder 32 in the right bank 28R. The uppermost cylinder 32 in the right bank 28R is located at a position higher than that of the uppermost cylinder 32 in the left bank 28L. The middle cylinder 32 in the left bank 28L is located at a position higher than that of the lowermost cylinder 32 in the right bank 28R and lower than that of the middle cylinder in the right bank 28R. The uppermost cylinder 32 in the left bank 28L is located at a position higher than that of the middle cylinder 32 in the right bank 28R and lower than that of the uppermost cylinder in the right bank 28R. The cylinders 32 in the right bank 28R are offset upward with respect to the cylinders 32 in the left bank 28L by a distance OS. The cylinders may be offset in the opposite manner. More specifically, the cylinders 32 in the left bank 28L may be offset upward with respect to the cylinders 32 in the right bank 28R by the distance OS.

As shown in FIG. 6, the left bank 28L and the right bank 28R preferably are located bilaterally asymmetrically with respect to the center line L1. The positions in the left bank 28L and the right bank 28R in the front-rear direction preferably are substantially the same.

The crankcase 27 includes the crankshaft 13 accommodated therein. The center 13*a* of the crankshaft 13 is located on the center line L1.

In this preferred embodiment, the cylinder block 29 preferably is a unitary integral member. Alternatively, the cylinder block 29 may be a combination of a plurality of members. For example, a portion of the cylinder block 29 covering the crankshaft 13 and a portion of the cylinder block 29 including the cylinders 32 accommodated therein (in other words, a portion defining a so-called cylinder bore) may be separate from each other and secured to each other preferably by a bolt or other securing member, for example. The cylinder block 29 is secured to the crankcase 27 preferably by, for example, a bolt or other securing member, for example. In the present preferred embodiment, the cylinders 32 are formed preferably by forming a thin layer on an inner surface of the bore of the cylinder block 29 by thermal spraying, plating or other suitable process. Thus, the cylinders 32 preferably are integral with the cylinder block 29. Alternatively, the cylinders 32 may be formed separately from the cylinder block 29 and, for example, press-fit into the cylinder block 29. In each cylinder 32, the piston 33 is slidably located. The piston 33 is coupled to the crankshaft 13 via a connecting rod 34.

Figure 8:
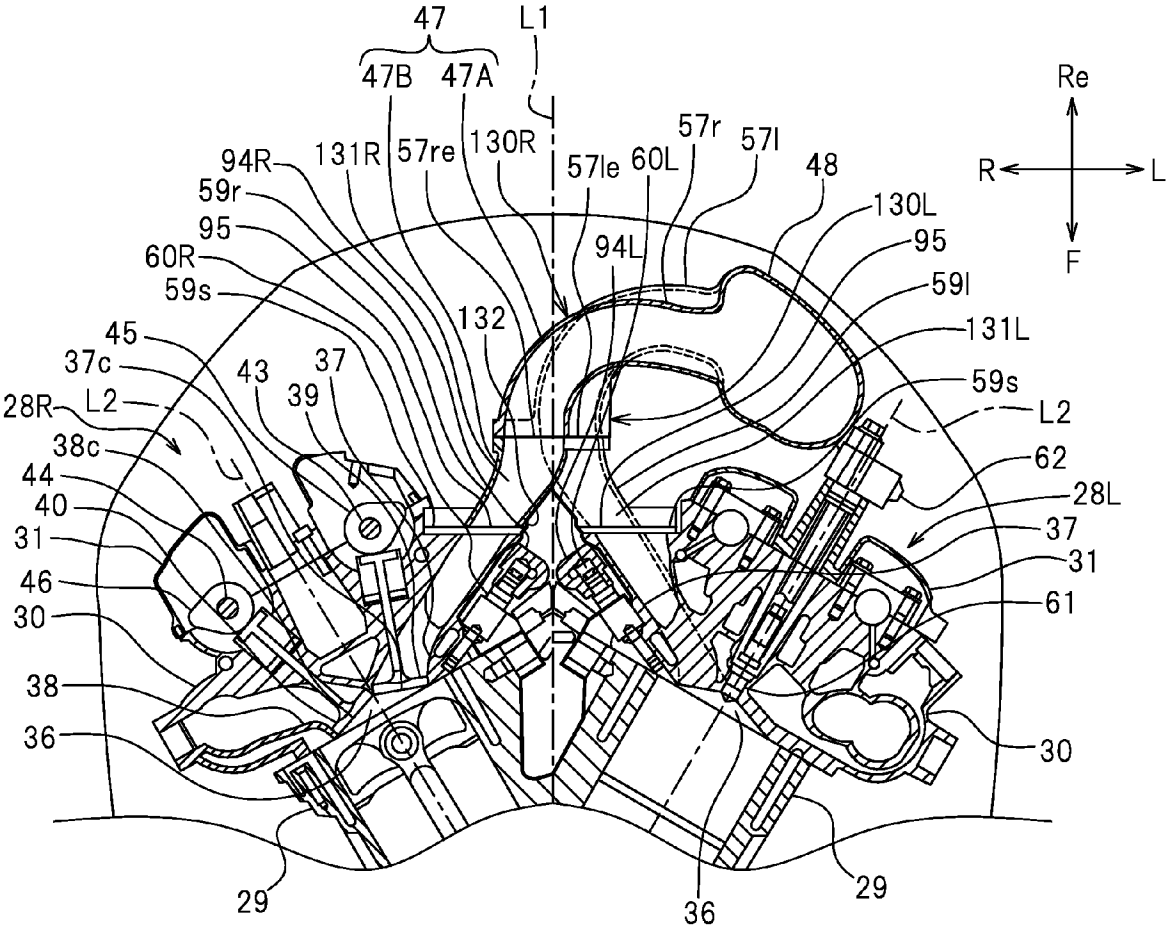
FIG. 8 is a horizontal cross-sectional view of a portion of the engine.

The cylinder head 30 is linked to a rear end portion of the cylinder block 29 preferably by bolts 41, for example. The cylinder head 30 includes a recess 35 provided therein. The recess 35, an inner wall of the cylinder 32 and an apex surface of the piston 33 define a combustion chamber 36. As shown in FIG. 8, the cylinder head 30 includes intake ports 37 and exhaust ports 38 facing each combustion chamber 36 provided therein (in FIG. 8, only one intake port 37 and only one exhaust ports 38 are shown). The cylinder head 30 accommodates an intake valve 39 arranged to open/close the intake port 37 and an exhaust valve 40 arranged to open/close the exhaust port 38. The intake port 37 is located inward relative to a cylinder axis line L2 in the outboard motor width direction. A center of an open end and a center of an intake valve 39 of the intake port 37 (these centers match each other and thus will be referred to simply as the "center 37*c* of the intake port 37", hereinafter) are located inward relative to the cylinder axis line L2 in the outboard motor width direction. The exhaust port 38 is located outward relative to the cylinder axis line L2 in the outboard motor width direction. A center of an open end and a center of an exhaust valve 40 of the exhaust valve 38 (these centers match each other and thus will be referred to simply as the "center 38*c* of the exhaust port 38", hereinafter) are located outward relative to the cylinder axis line L2 in the outboard motor width direction.

As shown in FIG. 6, the head cover 31 is linked to a rear end portion of the cylinder head 30 preferably by a bolt 42, for example.

The engine 8 directly injects fuel into the combustion chambers 36. As shown in FIG. 8, the cylinder heads 30 are respectively provided with fuel injection devices 60L and fuel injection devices 60R to inject fuel (in FIG. 8, only one fuel injection device 60L and only one fuel injection device 60R are shown). As seen in a plan view, the fuel injection devices 60L and 60R are located between an assembly of the cylinder head 30 and the cylinder block 29 in the left bank 28L and an assembly of the cylinder head 30 and the cylinder block 29 in the right bank 28R. More specifically, as seen in a plan view, the fuel injection devices 60L and 60R are located in an area 132 enclosed by the cylinder head 30 in the left bank 28L, the cylinder block 29 in the left bank 28L, the cylinder block 29 in the right bank 28R and the cylinder head 30 in the right bank 28R.

The fuel injection device 60L in the left bank 28L is located in an obliquely rearward and rightward orientation. The fuel injection device 60L is located to the right of the intake port 37 in the left bank 28L so as to be parallel or substantially parallel to the intake port 37. At least a portion of the left fuel injection device 60L is located to the left of the center line L1.

In this example, the entirety of the left fuel injection device 60L is located to the left of the center line L1.

The fuel injection device 60R in the right bank 28R is arranged in an obliquely rearward and leftward orientation. The fuel injection device 60R is located to the left of the intake port 37 in the right bank 28R so as to be parallel or substantially parallel to the intake port 37. At least a portion of the right fuel injection device 60R is located to the right of the center line L1. In this example, the entirety of the right fuel injection device 60R is located to the right of the center line L1.

The cylinder head 30 accommodates ignition plugs 61 (only one is shown in FIG. 8) as ignition devices. Each ignition plug 61 is inserted into the corresponding cylinder head 30 along the cylinder axis line L2 and is located in a center portion of the cylinder head 30. A tip portion of the ignition plug 61, which is an ignition portion, is located in the combustion chamber 36. As shown in FIG. 6, a connector 62 for the ignition plug 61 is attached to the head cover 31. Although not shown, the connector 62 is connected to an electric wire.

As shown in FIG. 8, inside each head cover 31 and each cylinder head 30, an intake cam shaft 43 and an exhaust cam shaft 44 are provided. The intake cam shaft 43 is located inward relative to the cylinder axis line L2 in the outboard motor width direction, and the exhaust cam shaft 44 is located outward relative to the cylinder axis line L2 in the outboard motor width direction. The intake cam shaft 43 is provided with intake cams 45 (only one is shown in FIG. 8) arranged to drive the intake valve 39. The exhaust cam shaft 44 is provided with an exhaust cam 46 arranged to drive the exhaust valve 40. Although not shown, the intake cam shaft 43 and the exhaust cam shaft 44 are coupled to the crankshaft 13 preferably via a chain or a belt, for example. The intake cam shaft 43 and the exhaust cam shaft 44 are driven by the crankshaft 13 and rotated together with the crankshaft 13.

As shown in FIG. 5, the outboard motor 1 includes, as the intake system to supply air to the engine 8, the throttle body 50 including a throttle valve 49 (see FIG. 9) accommodated therein, the surge tank 48 connected to the throttle body 50, and the intake manifold 47 arranged to connect the surge tank 48 and all the intake ports 37 to each other. As shown in FIG. 8, the intake manifold 47 defines left and right intake paths 130L and 130R. In FIG. 6, reference sign 131 represents a front end of an overlapping portion of the intake paths 130L and 130R as seen in a plan view.

Figure 9:
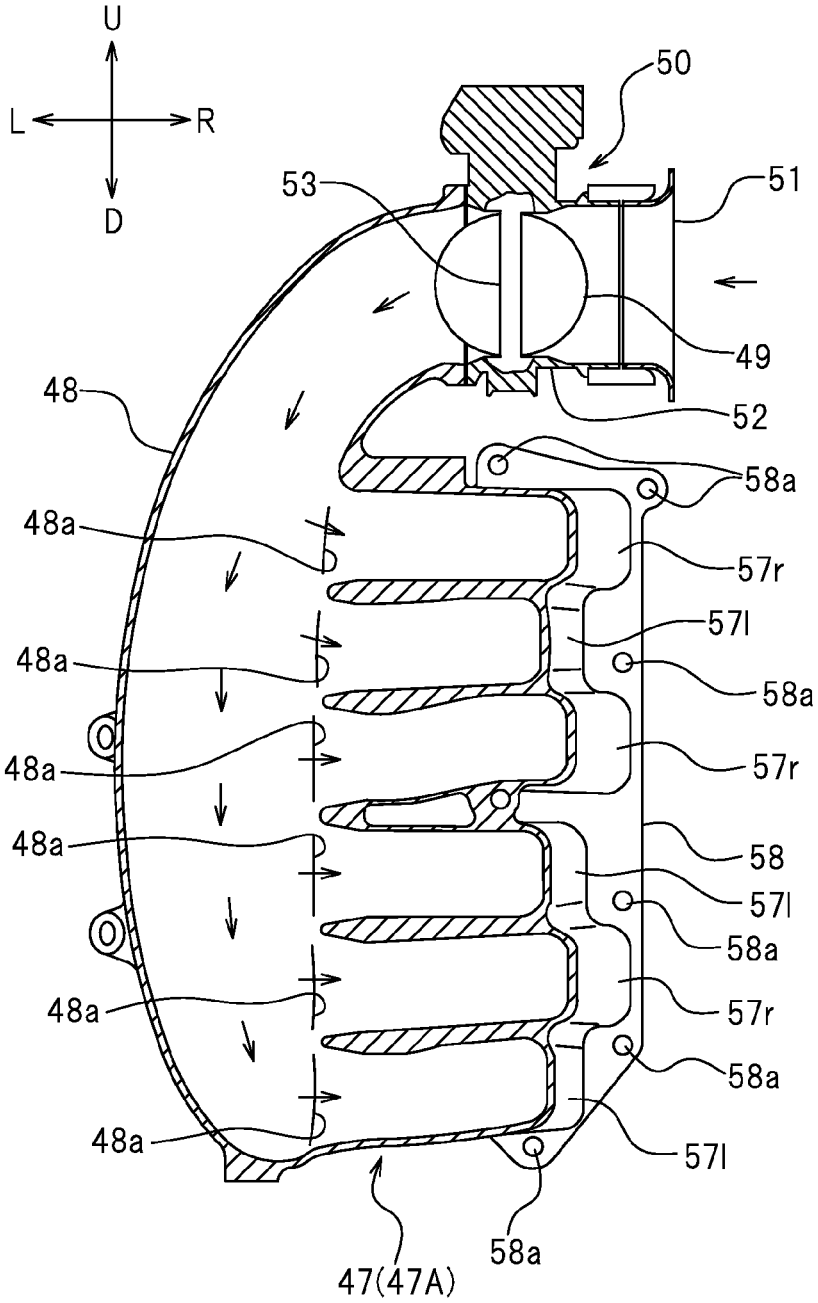

FIG. 9 is a vertical cross-sectional view of the throttle body 50, the surge tank 48 and the like as seen from the rear side. As shown in FIG. 9, the throttle body 50 includes a tubular portion 52 that is preferably substantially tubular-shaped and arranged to extend in the left-right direction, and a throttle shaft 53 extending in the vertical direction and supporting the throttle valve 49 such that the throttle valve 49 is rotatable. The throttle valve 49 rotates about the throttle shaft 53 and thus changes a flow path cross-sectional area size of the tubular portion 52. As the flow path cross-sectional area size of the tubular portion 52 is increased, the amount of the sucked air is increased and thus an engine output is increased. In contrast, as the flow path cross-sectional area size of the tubular portion 52 is decreased, the amount of the sucked air is decreased and thus the engine output is decreased. As shown in FIG. 5, the throttle body 50 is located at a center in the outboard motor width direction. A portion of the throttle body 50 is located in a vertical plane P1 including the center line L1.

As shown in FIG. 9, a right portion of the throttle body 50 is connected to a funnel 51. The funnel 51 is a member arranged to smooth the flow of the sucked air and expands rightward. The funnel 51 is opened rightward. As shown in FIG. 5, the funnel 51 is located to the right of the center line L1.

As shown in FIG. 9, the surge tank 48 is connected to a left portion of the throttle body 50. The surge tank 48 relaxes the change of intake pressure of the engine 8. In the present preferred embodiment, the throttle body 50 is directly connected to the surge tank 48. Alternatively, another member such as a duct or the like may be provided between the throttle body 50 and the surge tank 48, for example. More specifically, the throttle body 50 and the surge tank 48 may be connected to each other indirectly via a duct or the like.

The surge tank 48 preferably has a shape that is longer in the vertical direction, and the length thereof in the up-down direction is longer than the length thereof in the front-rear direction and also the length thereof in the left-right direction. As shown in FIG. 5, the length of the surge tank 48 in the up-down direction is approximately equal to the length of the cylinder head 30 in the up-down direction. As shown in FIG. 6, the length (represented by reference sign 48L) of the surge tank 48 in the left-right direction is shorter than a length 31L of the head cover 31 in the left-right direction.

As shown in FIG. 6, the surge tank 48 is located to the left of the center line L1. The surge tank 48 is located rearward relative to the head cover 31 in the left bank 28L. The surge tank 48 is integrally provided with a boss 54. The boss 54 is secured preferably by a bolt 56, for example, to a boss 55*t* that is preferably integrally formed with the head cover 31. In this manner, a left portion of the surge tank 48 is secured to the head cover 31 in the left bank 28L.

The surge tank 48 is located between the head cover 31 in the left bank 28L and the cowling 16 (in more detail, the top cowl 14). A rear wall 48*b* of the surge tank 48 is arranged to be parallel or substantially parallel to an inner wall 16*b* of the cowling 16. In other words, the rear wall 48*b* of the surge tank 48 is arranged so as to correspond to the shape of the cowling 16. As a result, a gap between the rear wall 48*b* of the surge tank 48 and the inner wall 16*b* of the cowling 16 can be made small. A front wall 48*f* of the surge tank 48 is preferably arranged parallel or substantially parallel to the head cover 31. In other words, the front wall 48*f* of the surge tank 48 is arranged so as to correspond to the shape of the head cover 31. As a result, a gap between the head cover 31 and the front wall 48*f* of the surge tank 48 can be made small. Therefore, the surge tank 48 can be guaranteed to have a large volume while interference of the surge tank with the cowling 16 and the head cover 31 is avoided. According to the present preferred embodiment, the surge tank 48 having a sufficient volume can be located in a space enclosed by the center line L1, the cowling 16 and the left bank 28L as seen in a plan view.

As shown in FIG. 6, in a horizontal cross-section, the interior of the surge tank 48 becomes wider rightward, specifically, toward the intake manifold 47.

As shown in FIG. 9, the air sucked into the surge tank 48 flows generally downward in the surge tank 48. An area size of the horizontal cross-section of the surge tank 48, specifically, the flow path cross-sectional area size, first increases and then decreases downward. The flow path cross-sectional area size of the surge tank 48 is maximum in the vicinity of a position between the upper three cylinders and the lower three cylinders of the engine 8 (in other words, at a center position of the engine 8 in the up-down direction). In order to smooth the flow of the air, the surge tank 48 preferably has a shape such that a cross-sectional area size is continuously changed downward. In this example, the surge tank 48 preferably has a streamline shape, for example. It should be noted that the specific shape of the surge tank 48 is not limited, and the surge tank 48 may have a shape with which the flow path cross-sectional area size changes step by step, for example. Alternatively, the surge tank 48 may have a shape having a uniform flow path cross-sectional area size.

The surge tank 48 preferably includes six outlets 48*a*, for example, arranged in the up-down direction. The outlets 48*a* are each opened rightward.

The surge tank 48 is connected to the intake manifold 47. As shown in FIG. 8, the intake manifold 47 preferably includes two members assembled together, specifically, an upstream portion 47A and a downstream portion 47B. The upstream portion 47A preferably is integrally formed with the surge tank 48. The surge tank 48 and the upstream portion 47A preferably are integrally formed of a synthetic resin. It should be noted that the material of the surge tank 48 and the upstream portion 47A is not specifically limited, and the surge tank 48 and the upstream portion 47A may be formed of a metal material such as an aluminum alloy or other suitable material, for example. The downstream portion 47B preferably is formed of a metal material, and is preferably formed of, in this example, an aluminum alloy. It should be noted that the material of the downstream portion 47B is not specifically limited, either. The upstream portion 47A and the surge tank 48 may be separate members. Alternatively, the intake manifold 47 may be defined by a single unitary member. There is no specific limitation on the material of the surge tank 48 or the material of the intake manifold 47.

As shown in FIG. 9, the upstream portion 47A of the intake manifold 47 preferably includes a total of six, for example, intake pipes 57*r* and 57*l* arranged in the vertical direction. The upstream portion 47A is integrally connected to the surge tank 48 such that the intake pipes 57*r* and 57*l* are respectively connected to the outlets 48*a* of the surge tank 48. The first, third and fifth intake pipes 57*r* counted from above supply air to the intake ports 37 in the right bank 28R. The second, fourth and sixth intake pipes 57*l* counted from above supply air to the intake ports 37 in the left bank 28R. The intake pipes 57*r* and the intake pipes 57*l* are curved in different manners so as to supply air to the respective intake ports 37 smoothly. In more detail, as shown in FIG. 8, as seen in a plan view, an upstream end of intake pipes 57*l* is offset rearward with respect to an upstream end of the intake pipes 57*r*, and a downstream end of the intake pipes 57*l* is offset leftward with respect to a downstream end of the intake pipes 57*r*. A center 57*le* of the downstream end of the intake pipes 57*l* is located to the left of the center line L1. A center 57*re* of the downstream end of the intake pipes 57*r* is located to the right of the center line L1.

As shown in FIG. 9, a flange 58 including a plurality of holes 58*a* is provided at a downstream end of the upstream portion 47A. Although not shown, a flange similar to the flange 58 is provided also in the downstream portion 47B of the intake manifold 47. A bolt is inserted into each hole 58*a*, and both of the flanges are linked to each other preferably via the bolts, for example.

As shown in FIG. 8, the downstream portion 47B of the intake manifold 47 includes an intake pipe 59*r* connected to each intake pipe 57*r* and an intake pipe 59*l* connected to each intake pipe 57*l*. The downstream portion 47B is located forward with respect to the upstream portion 47A. The intake pipe 59*r* connects the intake pipe 57*r* and the intake port 37 in the right bank 28R to each other. The intake pipe 59*l* connects the intake pipe 57*l* and the intake port 37 in the left bank 28L to each other. At downstream ends of the intake pipes 59*r* and 59*l*, flanges 59*s* are provided. Also at upstream ends of intake ports 37, similar flanges are provided. Both of the flanges 59*s* are linked to each other preferably by a bolt (not shown), for example.

The intake pipe 59*l* extends in an oblique rearward and rightward direction from the cylinder head 30 in the left bank 28L. The intake pipe 59*r* extends in an oblique rearward and leftward direction from the cylinder head 30 in the right bank 28R. In order to guide air smoothly from the intake pipes 59*l* and 59*r* to the intake ports 37, the downstream end portions of the intake pipes 59*l* and 59*l* are each located on a line extended from the upstream end portion of the corresponding intake port 37. The downstream end portions of the intake pipes 59*l* and 59*l* and the upstream end portions of the intake ports 37 are located such that centers thereof match each other respectively.

Figure 10:
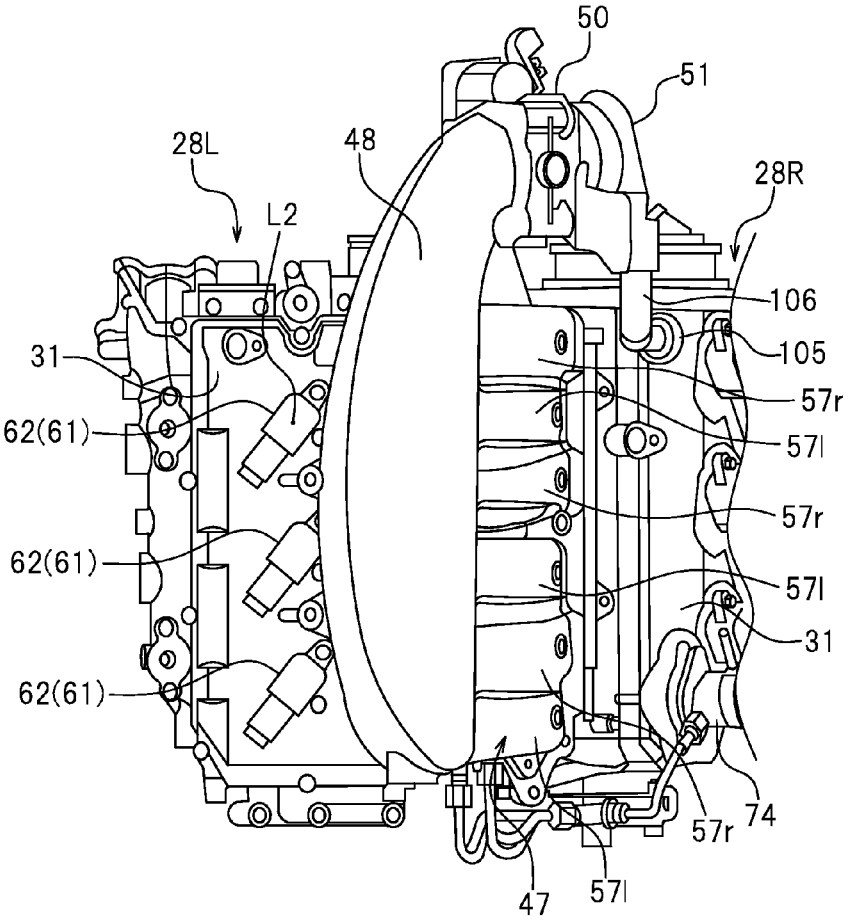
FIG. 10 is a view of a left bank as seen from an obliquely rearward position in the direction of a cylinder axis line.

FIG. 10 shows the left bank 28L, the surge tank 48 and the like as seen from a position which is obliquely rearward and leftward thereto in the direction of the cylinder axis line L2 in the left bank 28L. As shown in FIG. 10, as seen in the direction of the cylinder axis line L2, the lowermost connector 62 does not overlap the surge tank 48. Therefore, the lowermost connector 62, together with the ignition plug 61 connected thereto, can be pulled out from the cylinder head 30 and the head cover 31 without being obstructed by the surge tank 48. Similarly, the lowermost connector 62 and the ignition plug 61 can be inserted into the cylinder head 30 and the head cover 31 without being obstructed by the surge tank 48. Thus, maintenance can be performed easily.

The entirety of the ignition plug 61 and the connector 62 will be referred to as an "ignition device". In the present preferred embodiment, preferably only a portion of the plurality of ignition devices is located so as not to overlap the surge tank 48 as seen in the direction of the cylinder axis line L2. It should be noted that the size or the shape of the surge tank 48 can be changed such that none of the ignition devices overlaps the surge tank 48 as seen in the direction of the cylinder axis line L2. In this manner, the ease of maintenance of the ignition devices can be further improved.

As shown in FIG. 2, the outboard motor 1 includes, as the exhaust system to discharge the exhaust gas from the engine 8, exhaust manifolds 63 each preferably integrally formed with the corresponding cylinder head 30, catalyst cases 65 each including a catalyst 64 accommodated therein, top exhaust pipes 66 each arranged to connect the corresponding exhaust manifold 63 and a top end portion of the corresponding catalyst case 65 to each other, bottom exhaust pipes 67 (see FIG. 11) each arranged to connect a bottom end portion of the corresponding catalyst case 65 and a side portion of a bottom portion of the corresponding cylinder block 29 to each other, and an exhaust path 68 (see FIG. 1) arranged to discharge the exhaust gas from the bottom exhaust pipes 67 to the outside of the outboard motor 1. The top exhaust pipes 66, the catalyst cases 65 and the bottom exhaust pipes 67 are separate members, but a portion, or all of, these members may be integrated together. In the following description, the top exhaust pipe 66, the catalyst case 65 and the bottom exhaust pipe 67 will be collectively referred to as an "exhaust pipe 120".

Figure 11:
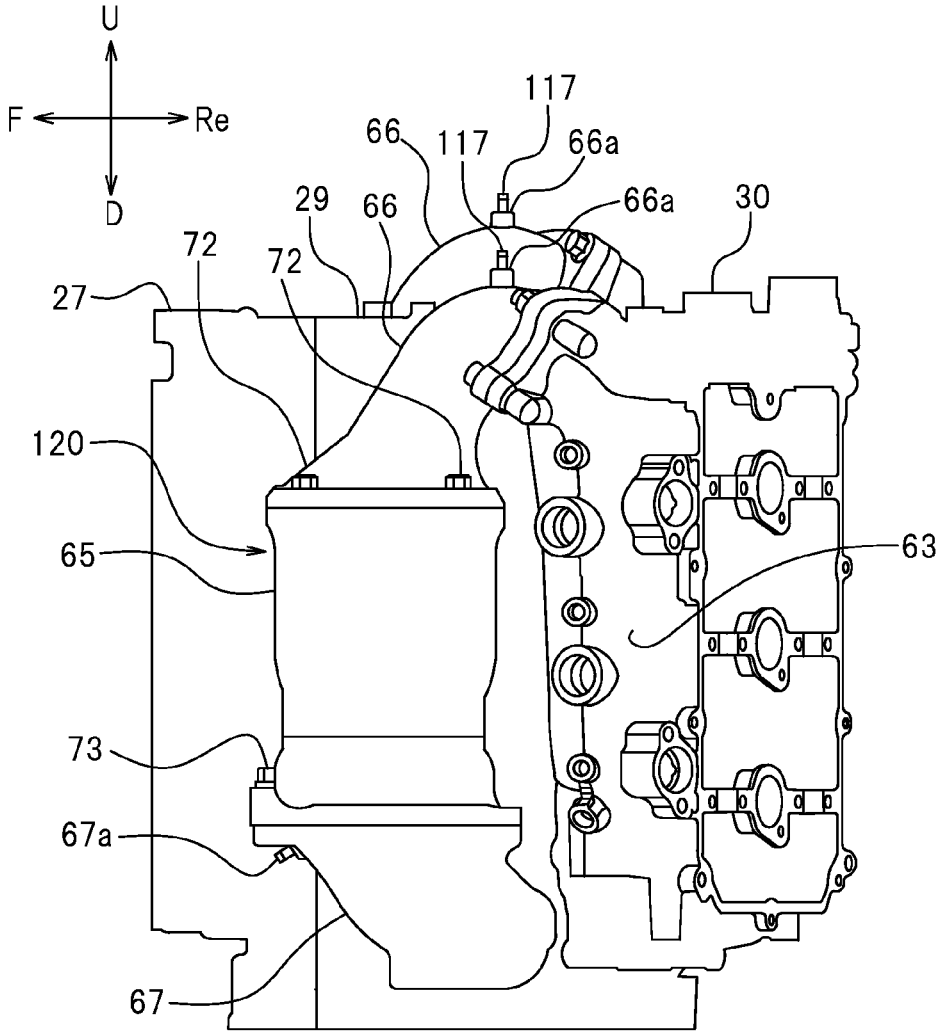
Figure 12:
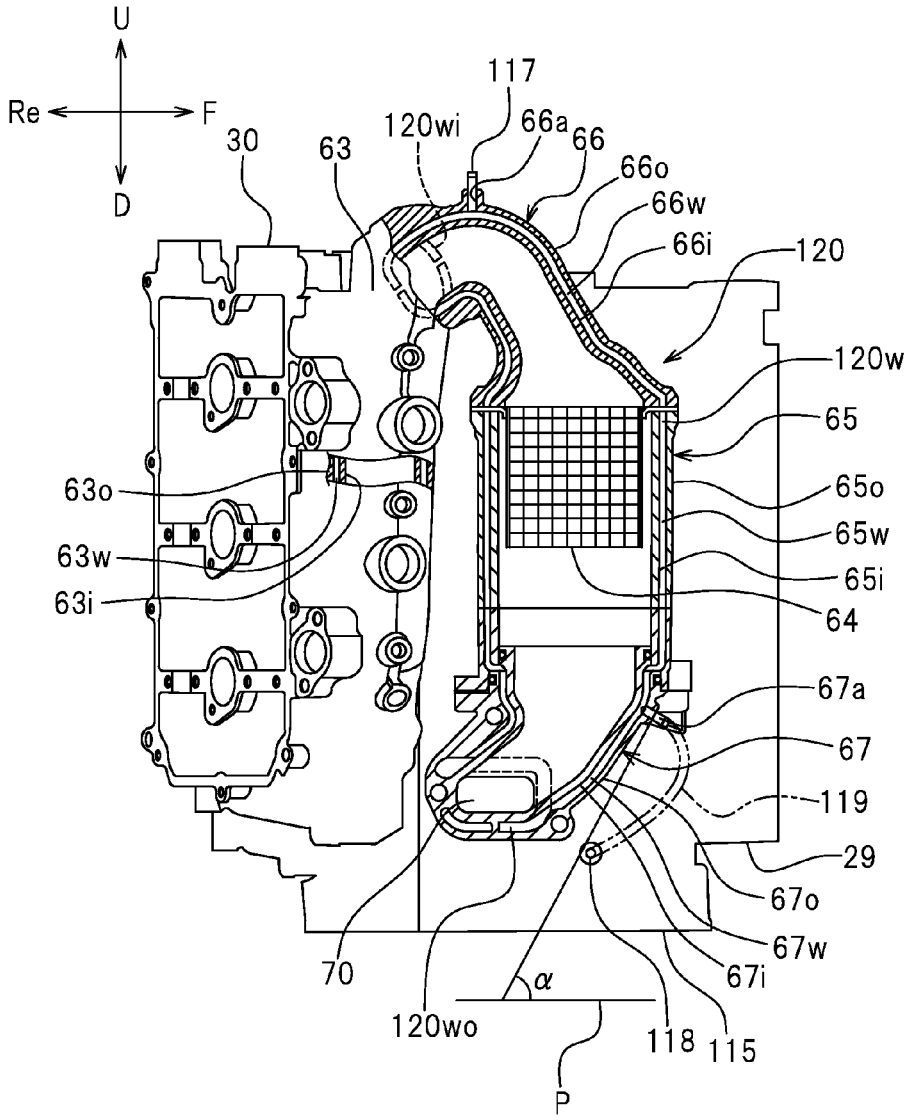
FIG. 12 is a partially-cut right side view of the engine which shows a portion of the exhaust manifold and a portion of the exhaust pipe.

As shown in FIG. 2, the exhaust manifolds 63 are respectively located to the left of the exhaust port 38 in the left bank 28L and to the right of the exhaust port 38 in the right bank 28R. As shown in FIG. 11, the exhaust manifold 63 extends upward. As shown in FIG. 12, the exhaust manifold 63 includes an inner pipe 63*i* and an outer wall 63*o* which encloses a circumference of the inner pipe 63*i* and is integral with the cylinder head 30. The exhaust flows in the inner pipe 63*i*. Between the inner pipe 63*i* and the outer wall 63*o* integral with the cylinder head 30, a water jacket 63*w* in which the cooling water flows is provided. A side surface of the inner pipe 63*i* of the exhaust manifold 63 includes a plurality of inlets (not shown) arranged in the vertical direction. The exhaust port 38 is arranged to communicate with the inlets. The exhaust gas, discharged from the exhaust port 38 to the exhaust manifold 63 via the inlets, flows upward in the inner pipe 63*i* of the exhaust manifold 63 and is joined with the exhaust gas from the other exhaust port 38.

As described above, the exhaust manifold 63 preferably is integrally formed with the cylinder head 30 in the present preferred embodiment, but the exhaust manifold 63 and the cylinder head 30 may be separate members. The exhaust manifold 63 and the cylinder head 30, which are separate members, may be linked to each other preferably by a bolt or other joining member, for example.

As shown in FIG. 12, the top exhaust pipe 66 is a so-called double tube pipe, and includes an inner pipe 66*i* and an outer pipe 66*o* arranged to enclose a circumference of the inner pipe 66*i*. The exhaust gas flows in the inner pipe 66*i*. Between the inner pipe 66*i* and the outer pipe 66*o*, a water jacket 66*w* in which the cooling water flows is provided. As shown in FIG. 2, each top exhaust pipe 66 is located along the cylinder block 29 as seen in a plan view. Specifically, the left top exhaust pipe 66 extends in an oblique rearward and leftward direction, like the cylinder block 29 in the left bank 28L. The right top exhaust pipe 66 extends in an oblique rearward and rightward direction, like the cylinder block 29 in the right bank 28R. As shown in FIG. 12, a bottom end portion of the top exhaust pipe 66 expands downward.

As shown in FIG. 11, a top end portion of the catalyst case 65 is secured to the bottom end portion of the top exhaust pipe 66 preferably by bolts 72, for example. As shown in FIG. 12, the catalyst case 65 preferably includes a double tube pipe including an inner pipe 65*i* and an outer pipe 65*o*. The outer pipe 65*o* is located concentrically with the inner pipe 65*i* and encloses a circumference of the inner pipe 65*i*. The exhaust gas flows in the inner pipe 65*i*. Between the inner pipe 65*i* and the outer pipe 65*o*, a water jacket 65*w* in which the cooling water flows is provided. Inside the inner pipe 65*i*, the catalyst 64 is located. As shown in FIG. 6, each catalyst case 65 preferably has a circular or substantially circular cross-section, and each catalyst 64 also preferably has a circular or substantially circular cross-section. It should be noted that the cross-sectional shape of the catalyst 64 is not specifically limited, and may be appropriately changed to be suitable to the cross-sectional shape of the catalyst case 65. The catalyst 64 is not limited to being located in the inner pipe 65*i* and being one in number. Two or more catalysts 64 may be provided, for example.

As shown in FIG. 6, as seen in a plan view, each catalyst case 65 is located outward relative to the V-bank. The left catalyst case 65 is located to the left of the left bank 28L, and the right catalyst case 65 is located to the right of the right bank 28R. As seen in a plan view, each catalyst case 65 is located in an area enclosed by the crankcase 27, the cylinder block 29, the cylinder head 30 and a side wall of the cowling 16.

As seen in a plan view, a center 65*c* of each catalyst case 65 is located at a position forward with respect to a rear end 29*b* of the cylinder block 29 and rearward with respect to a front end 27*f* (see FIG. 2) of the crankcase 27. The center 65*c* of the catalyst case 65 is located rearward relative to the center 13*a* of the crankshaft 13. In the case where the cross-section of the catalyst case 65 is not circular, the center of gravity of the catalyst case 65 may be regarded as the center thereof. A front end 65*f* of the catalyst case 65 is located rearward relative to the front end 27*f* of the crankcase 27. A rear end 65*b* of the catalyst case 65 is located rearward relative to the rear end 27*b* of the crankcase 27.

As shown in FIG. 6, an outermost end 65*oe* of each catalyst cast 65 in the outboard motor width direction is located at substantially the same position as that of an outermost end 30*oe* of the cylinder head 30 in the outboard motor width direction. The outermost end 65*oe* of the catalyst cast 65 in the outboard motor width direction is located outward relative to an outermost end 29*oe* of the cylinder block 29 in the outboard motor width direction, and an innermost end 65*ie* of the catalyst cast 65 in the outboard motor width direction is located inward relative to the outermost end 29*oe* of the cylinder block 29 in the outboard motor width direction. The center 65*c* of the catalyst case 65 is located outward relative to the outermost end 29*oe* of the cylinder block 29 in the outboard motor width direction.

As shown in FIG. 3, the length of the catalyst case 65 in the vertical direction is longer than the diameter of each cylinder 32. As shown in FIG. 11, the length of the catalyst case 65 in the vertical direction is about half of the length of the cylinder head 30 in the vertical direction. As shown in FIG. 12, the length of the catalyst 64 in the catalyst case 65 in the vertical direction is equal to, or longer than, the diameter of each cylinder 32.

As shown in FIG. 12, the bottom exhaust pipe 67 is also a double tube pipe, and includes an inner pipe 67*i* and an outer pipe 67*o*. The exhaust gas flows in the inner pipe 67*i*. Between the inner pipe 67*i* and the outer pipe 67*o*, a water jacket 67*w* in which the cooling water flows is provided. A top end portion of the bottom exhaust pipe 67 expands upward. As shown in FIG. 11, the top end portion of the bottom exhaust pipe 67 is secured to a bottom end portion of the catalyst case 65 by a bolt 73, for example. As shown in FIG. 12, the side portion of the bottom portion of the cylinder block 29 includes a flow-in opening 70 opened outward in the outboard motor width direction. A bottom end portion of the exhaust pipe 67 is secured to the side portion of the bottom portion of the cylinder block 29 so as to face the flow-in opening 70.

The flow path cross-sectional area size of the inner pipe 65*i* of the catalyst case 65 is larger than the flow path cross-sectional area size of an intermediate portion of the inner pipe 66*i* of the top exhaust pipe 66 and is also larger than the flow path cross-sectional area size of an intermediate portion of the inner pipe 67*i* of the bottom exhaust pipe 67. Specifically, in a portion extending from the exhaust manifold 63 to the cylinder head 30, the flow path cross-sectional area size of the path for discharge first increases and then decreases. The catalyst 64 is located in an area of the above-described path at which the flow path cross-sectional area size is increased. In the present preferred embodiment, the catalyst 64 is located in an area of the above-described path which has the largest flow path cross-sectional area size.

Figure 13:
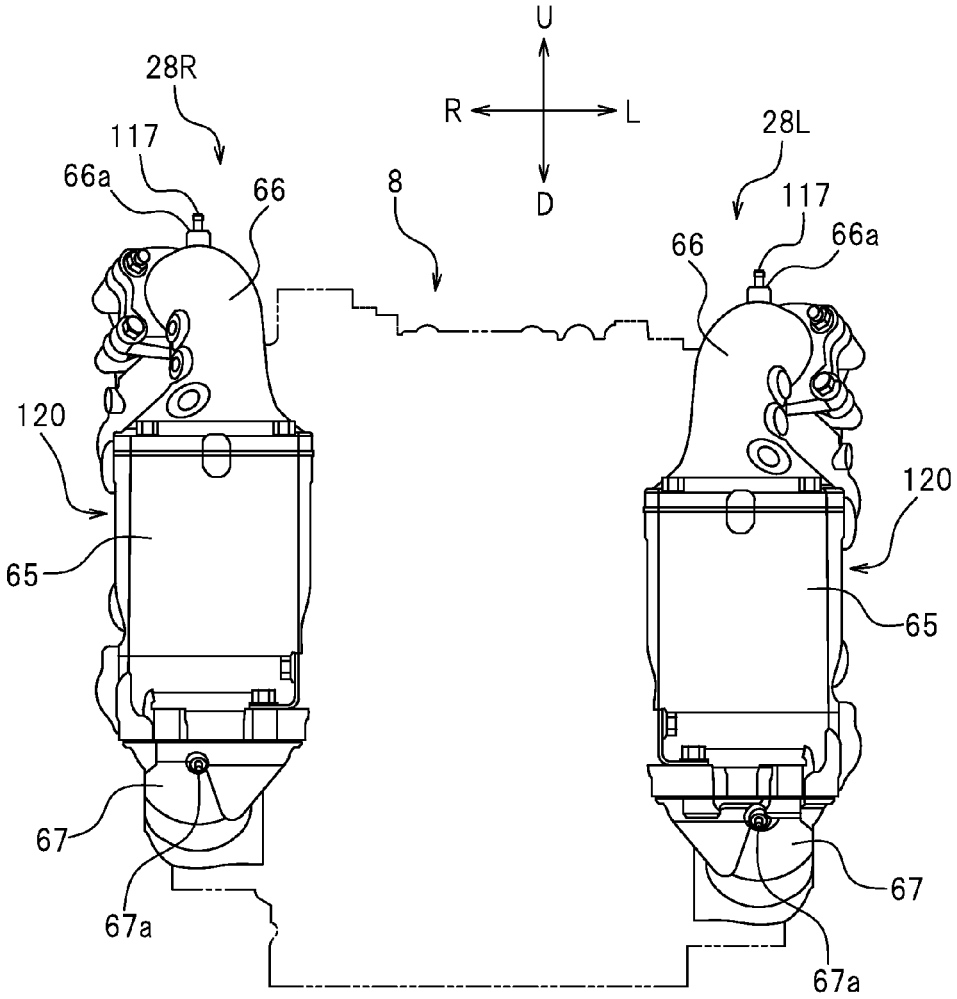
FIG. 13 is a front view of the exhaust pipe.

As described above with reference to FIG. 7, the cylinders 32 in the right bank 28R are offset upward with respect to the cylinders 32 in the left bank 28L. As shown in FIG. 13, in correspondence with the offset, the exhaust pipe 120 in the right bank 28R is offset upward with respect to the exhaust pipe 120 in the left bank 28L. Specifically, the top exhaust pipe 66 in the right bank 28R is offset upward with respect to the top exhaust pipe 66 in the left bank 28L, the catalyst case 65 in the right bank 28R is offset upward with respect to the catalyst case 65 in the left bank 28L, and the bottom exhaust pipe 67 in the right bank 28R is offset upward with respect to the bottom exhaust pipe 67 in the left bank 28L. These elements in the left bank 28L and these elements in the right bank 28R may be offset in the opposite manner.

As shown in FIG. 12, in a bottom portion of the cylinder block 29, an attachment block 115, which is attachable to, for example, a support member (not shown) arranged to support the cylinder block 29, is provided. The attachment block 115 defines a portion of the cylinder block 29. Although not shown, inside the attachment block 115, an exhaust gas path is arranged to extend from the flow-in opening 70 to the bottom end portion of the cylinder block 29. As shown in FIG. 1, the exhaust path 68 arranged to discharge the exhaust gas from the exhaust pipe 120 to the outside of the outboard motor 1 includes the above-mentioned exhaust gas path in the attachment block 115, an exhaust gas path in the upper case 17 and the lower case 18, and an exhaust path provided in the propeller shaft 11. The exhaust gas is discharged into the water through the exhaust path 68.

As shown in FIG. 2, the outboard motor 1 includes, as the fuel supply system to supply fuel to the engine 8, the fuel filter 19, the vapor separator tank 20, and the high-pressure fuel pump 74.

As schematically shown in FIG. 1, the hull 3 is provided with a fuel tank 76 having fuel stored therein. As shown in FIG. 2, the fuel filter 19 is connected to the fuel tank 76 via a fuel hose 75. Although not shown, inside the hull 3 or the outboard motor 1, a pump arranged to transport fuel from the fuel tank 76 toward the fuel filter 19 (hereinafter, this pump will be referred to as a "low-pressure fuel pump") is provided. The fuel filter 19 includes a cylindrical or substantially cylindrical case 19*a* (see FIG. 4) extending upward and a filter element (not shown) provided in the case 19*a*. As shown in FIG. 2, the fuel filter 19 is located between a front wall of the top cowl 14 of the cowling 16 and the crankcase 27 of the engine 8. The fuel filter 19 is located to the right of the center line L1.

The vapor separator tank 20 is connected to the fuel filter 19 via a fuel hose 77. The fuel transported from the fuel tank 76 by the low-pressure fuel pump is purified by passing through the fuel filter 19 and flows into the vapor separator tank 20.

The vapor separator tank 20 stores the fuel supplied from the fuel tank 76 and also separates vapor or air of the fuel from liquid fuel. The vapor separator tank 20 includes a tank 20*a* longer in the vertical direction (see FIG. 3), a pump (not shown) located inside the tank 20*a* (hereinafter, this pump will be referred to as an "in-tank high-pressure pump"), afloat (not shown) located inside the tank 20*a*, and a valve associated with the float. When the level of the liquid surface of the fuel in the tank 20*a* becomes equal to or higher than a prescribed level, the valve is closed and the flow of the fuel into the vapor separator tank 20 is stopped. By contrast, when the level of the liquid surface of the fuel in the tank 20*a* becomes lower than the prescribed level, the valve is opened and the fuel flows into the vapor separator tank 20.

As shown in FIG. 2, the vapor separator tank 20 is located to the left of the center line L1 and is located obliquely leftward and forward with respect to the crankcase 27. The vapor separator tank 20 is located rear to the fuel filter 19.

The high-pressure fuel pump 74 is attached to the head cover 31 in the right bank 28R. The high-pressure fuel pump 74 and the vapor separator tank 20 are connected to each other by a fuel hose 78. The fuel stored in the tank 20*a* of the vapor separator tank 20 is supplied to the high-pressure fuel pump 74 via the fuel hose 78 by the in-tank high-pressure fuel pump in the vapor separator tank 20.

An upstream end of the fuel hose 78 is connected to the vapor separator tank 20. As shown in FIG. 2 through FIG. 4, a portion of the fuel hose 78 is located below the exhaust pipe 120. In more detail, the fuel hose 78 passes below the exhaust pipe 120 and extends rearward or obliquely rearward. Alternatively, a portion of the fuel hose 78 may be located above the exhaust pipe 120 or above the cylinder block 29 or the like, instead of below the exhaust pipe 120.

Upstream with respect to the high-pressure fuel pump 74, the pressure of the fuel is not very high. Therefore, each of the fuel hose 75, the fuel hose 77 and the fuel hose 78 does not need to have a high pressure resistance. The material of each of the fuel hose 75, the fuel hose 77 and the fuel hose 78 is not specifically limited, and may be, for example, rubber, a resin or other suitable material, for example. The fuel hose 75, the fuel hose 77 and the fuel hose 78 may be each replaced with a pipe preferably formed of a resin, a metal material or other suitable material, for example.

As shown in FIG. 6, the high-pressure fuel pump 74 is a cam-driven fuel pump and is driven by the intake cam shaft 43 in the right bank 28R. The high-pressure fuel pump 74 is located to the right of the center line L1. Since the surge tank 48 is located to the left of the center line L1, it can be considered that the high-pressure fuel pump 74 is located on the left side or the right side with respect to the center line L1, which is the opposite side (right side) to the side where the surge tank 48 is located (left side). The high-pressure fuel pump 74 is located to the left of the cylinder axis line L2 in the right bank 28R. In other words, the high-pressure fuel pump 74 is located inward relative to the cylinder axis line L2 in the right bank 28R in the outboard motor width direction. As seen in a plan view, a gap between the head cover 31 and the cowling 16 in the right bank 28R is larger on the left side than on the right side with respect to the cylinder axis line L2 in the right bank 28R. Between the left side with respect to the cylinder axis line L2 and the head cover 31 in the right bank 28R, an open space is provided. In order to effectively use this space, the high-pressure fuel pump 74 is located in this space.

As shown in FIG. 5, the high-pressure fuel pump 74 is attached to a bottom portion of the head cover 31 in the right bank 28R. As described above, the cylinders 32 in the right bank 28R are offset upward with respect to the cylinders 32 in the left bank 28L. In order to effectively use the open space provided by such offset, the high-pressure fuel pump 74 is attached to a bottom portion of the left bank 28L or the right bank 28R, in which the cylinders 32 are offset upward. The head cover 31 includes an attachment section 31*k* provided therein to which the high-pressure fuel pump 74 is attachable. The head cover 31 is preferably formed of a resin and is easily molded, for example. According to the present preferred embodiment, the attachment section 31*k* for the high-pressure fuel pump 74 can be easily formed in the head cover 31.

Figure 14:
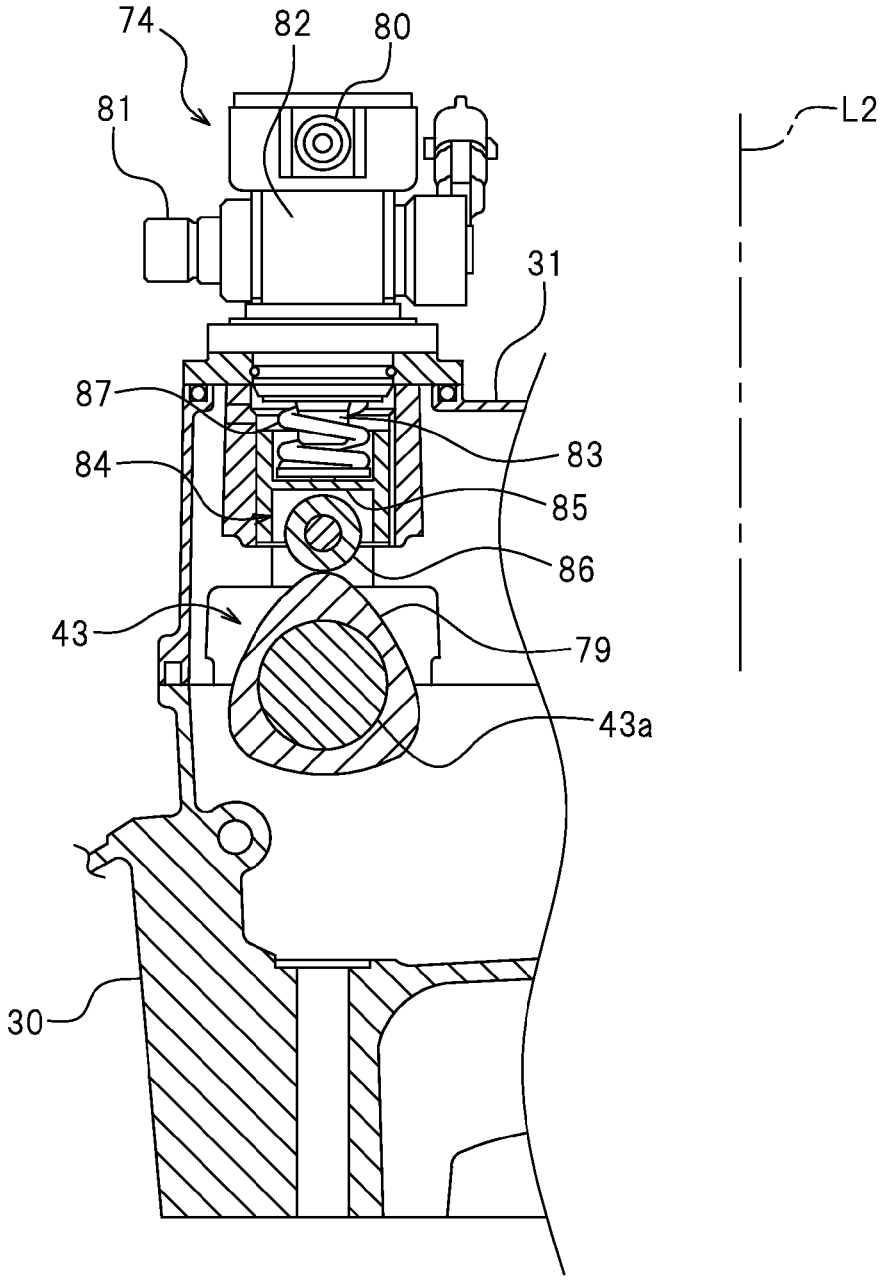
FIG. 14 is a horizontal cross-sectional view of a high-pressure fuel pump.
Figure 15:
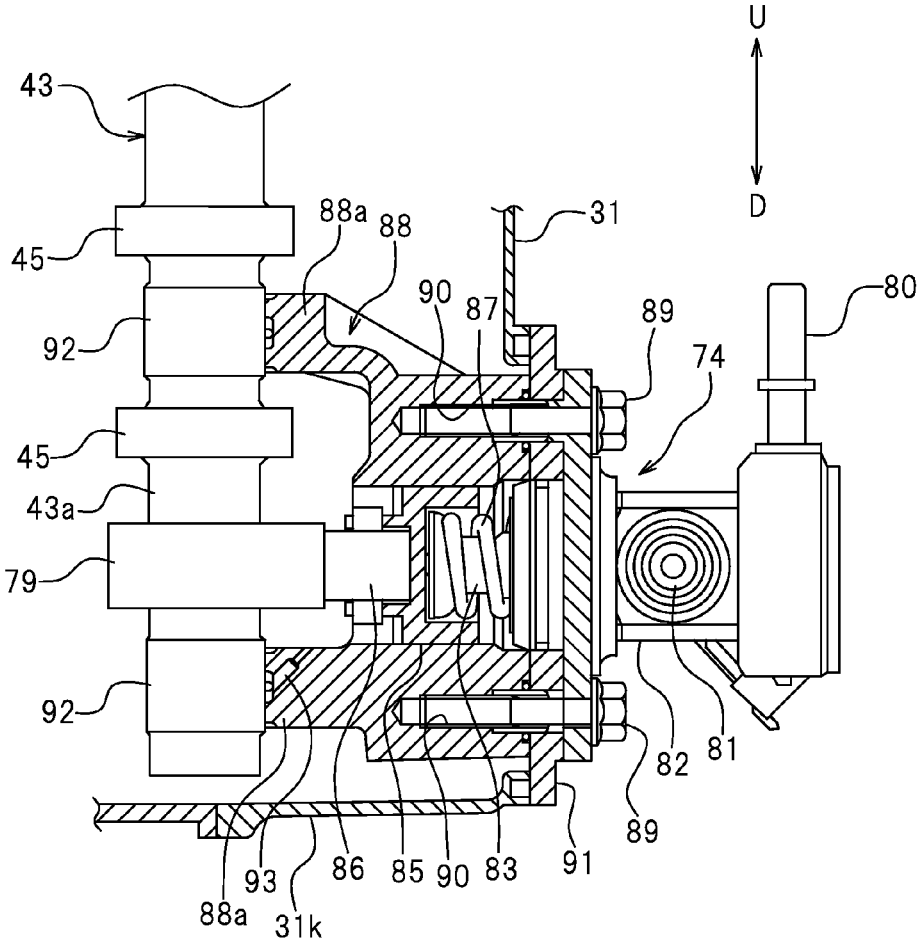
FIG. 15 is a vertical cross-sectional view of the high-pressure fuel pump.

FIG. 14 is a horizontal cross-sectional view of the high-pressure fuel pump 74, and FIG. 15 is a vertical cross-sectional view of the high-pressure fuel pump 74. The high-pressure fuel pump 74 includes an intake section 80 arranged to suck in fuel, an ejection section 81 arranged to eject fuel, and a pump main body 82. Although not shown, the following components are preferably provided inside the pump main body 28: a pressure chamber partially partitioned by a diaphragm, an intake check valve arranged to permit the fuel to flow only in a direction from the intake section 80 toward the pressure chamber, and an ejection check valve arranged to permit the fuel to flow only in a direction from the pressure chamber toward the ejection section 81. By a reciprocating motion of the diaphragm in the up-down direction in FIG. 14, the fuel is sucked into the pressure chamber from the intake section 80 and is ejected from the pressure chamber to the ejection section 81.

In the pump main body 82, a rod 83 including a rear end portion (top end portion in FIG. 14) which is coupled to the diaphragm is provided. The rod 83 is urged forward (downward in FIG. 14) by a coil spring 87. A front end portion (bottom end portion in FIG. 14) of the rod 83 is provided with a lifter 84. The lifter 84 includes a frame 85 in contact with the rod 83 and a roller 86 rotatably supported at a front portion of the frame 85. The rod 83 and the lifter 84 are arranged and operative to make a reciprocating motion integrally in the up-down direction in FIG. 14. The rod 83 and the lifter 84 are arranged and operative to make a reciprocating motion in a direction parallel or substantially parallel to the cylinder axis line L2.

The intake cam shaft 43 is provided with a pump driving cam 79 to drive the high-pressure fuel pump 74. The pump driving cam 79 may be integrally formed with a cam shaft main body 43*a*, but in the present preferred embodiment, the pump driving cam 79 preferably is separate from the cam shaft main body 43*a*. The pump driving cam 79 is preferably press-fit into the cam shaft main body 43*a*. The pump driving cam 79 may preferably be made of a material different from that of the cam shaft main body 43*a*. The material of the pump driving cam 79 is not specifically limited. For example, a sintered material, cast iron (ferrum casting ductile (FCD), etc.) or other suitable material is preferably usable. The roller 86 of the lifter 84 is in contact with the cam 79. When the cam 79 is rotated along with the rotation of the intake cam shaft 43, the lifter 84 in contact with the cam 79 makes a reciprocating motion. Along with this, the rod 83 makes a reciprocating motion, and the diaphragm is displaced in repetition. As a result, the fuel sucked from the intake section 80 is increased in pressure by the pressure chamber and is ejected from the ejection section 81 as high-pressure fuel.

Figure 16:
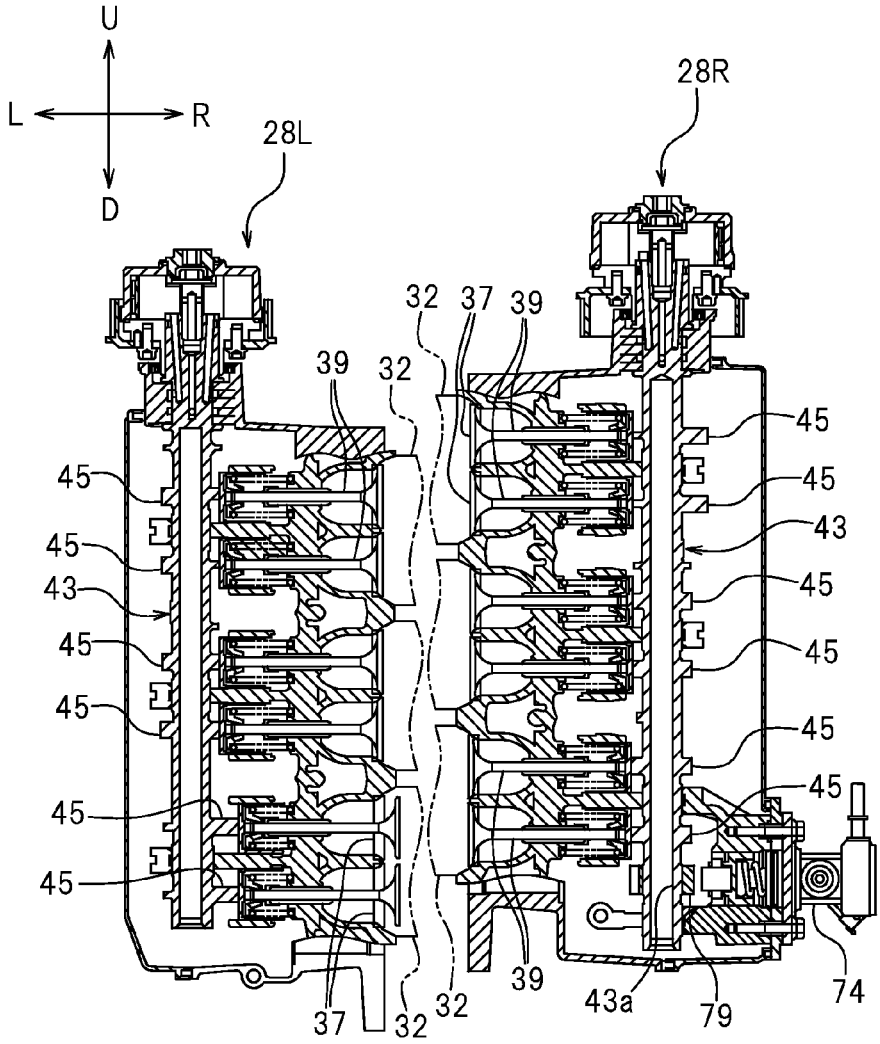
FIG. 16 is a vertical cross-sectional view of a portion of the left bank and a portion of a right bank.

As shown in FIG. 16, the pump driving cam 79 is provided at a bottom portion of the intake cam shaft 43 in the right bank 28R. The engine 8 according to the present preferred embodiment preferably includes two intake ports 37 and two exhaust ports 38 for each of the cylinders 32, for example. In the right bank 28R, the three cylinders 28 are provided, and the intake camshaft 43 is provided with six intake cams 45 arranged in the up-down direction. The cam 79 is provided at a position lower than these six intake cams 45. Specifically, the cam 79 is located lower than the lowermost cam among of the intake cams 45. Therefore, in the case where a member separate from the cam shaft main body 43*a* is fit into the camshaft main body 43*a* to define the cam 79, the work of fitting the separate member can be performed easily. It should be noted that the cam 79 is not limited to being a separate member and may be integrally formed with the cam shaft main body 43*a*.

As shown in FIG. 15, inside the head cover 31, a cam cap 88 is located as a support arranged to support the high-pressure fuel pump 74. The cam cap 88 includes a plurality of holes 90 into which bolts 89 are preferably inserted. The high-pressure fuel pump 74 is put on the cam cap 88 with a plate 91 being interposed therebetween. The high-pressure fuel pump 74, together with the plate 91, is secured to the cam cap 88 preferably by the bolts 89, for example. In this manner, the high-pressure fuel pump 74 is secured to the head cover 31 via the cam cap 88.

In a front portion of the cam cap 88 (left portion in FIG. 15), a bearing 88*a* to support the intake camshaft 43 is arranged such that the intake cam shaft 43 is rotatable. The bearing 88*a* includes an oil supply path 93 provided therein to supply a lubricant. Bearings 92 are provided between the lowermost intake cam 45 and second-to-the lowermost cam 45 provided to the intake cam shaft 43, and also below the pump driving cam 79. The bearings 92 may be each provided by causing a portion of the cam shaft main body 43*a* to have a larger diameter than the rest thereof, or by inserting a bearing member separate from the cam shaft main body 43*a*. Since the bearing 92 below the cam 79 is located at the lowermost end of the intake cam shaft 43, the separate bearing member can be inserted easily.

Although not shown in FIG. 15 or the like, a cover arranged to cover the high-pressure fuel pump 74 may be provided. Specifically, a portion of the high-pressure fuel pump 74 which is located outward relative to the head cover 31 may be covered with the cover.

Figure 17:
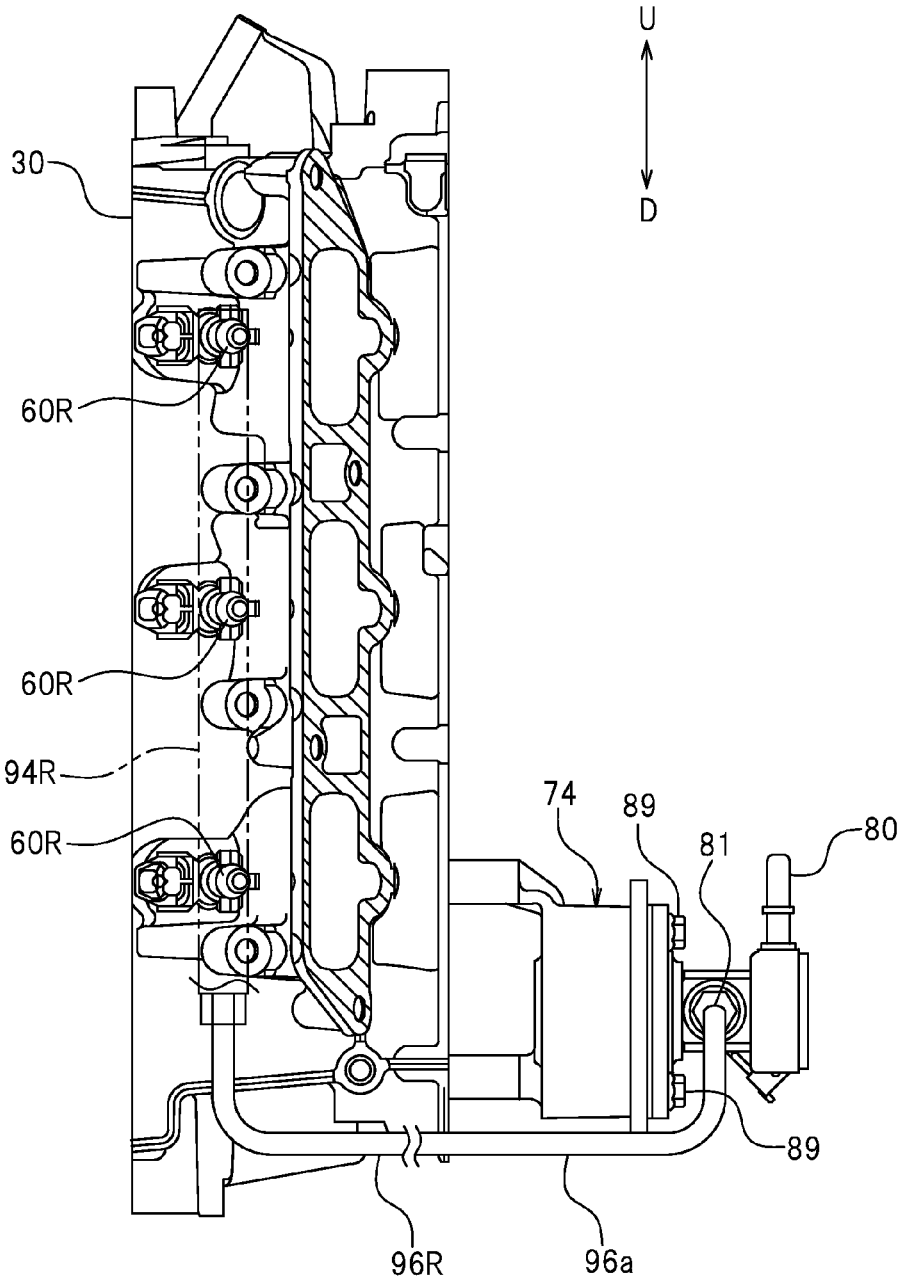

As shown in FIG. 8, to the right of the left bank 28L, a fuel supply rail 94L arranged to supply fuel to all the fuel injection devices 60L in the left bank 28L is provided. To the left of the right bank 28R, a fuel supply rail 94R arranged to supply fuel to all the fuel injection devices 60R in the right bank 28R is provided. The fuel supply rails 94L and 94R are fuel pipes arranged to supply fuel to the fuel injection devices 60L and 60R, respectively. As shown in FIG. 17, the fuel supply rail 94R extends in the vertical direction and is connected to each of the fuel injection devices 60R in the right bank 28R. Similarly, the fuel supply rail 94L extends in the vertical direction and is connected to each of the fuel injection devices 60L in the left bank 28R.

As shown in FIG. 8, as seen in a plan view, the fuel supply rail 94L and the fuel supply rails 94R are located in the area 132 enclosed by the left bank 28L, the right bank 28R and the intake manifold 47. The left fuel supply rail 94L is located to the left of the center line L1, and the right fuel supply rail 94R is located to the right of the center line L1. The fuel supply rail 94L and the fuel supply rail 94R are located forward with respect to joining surfaces 95 at which the cylinder heads 30 are joined to the intake manifold 47.

Figure 18:
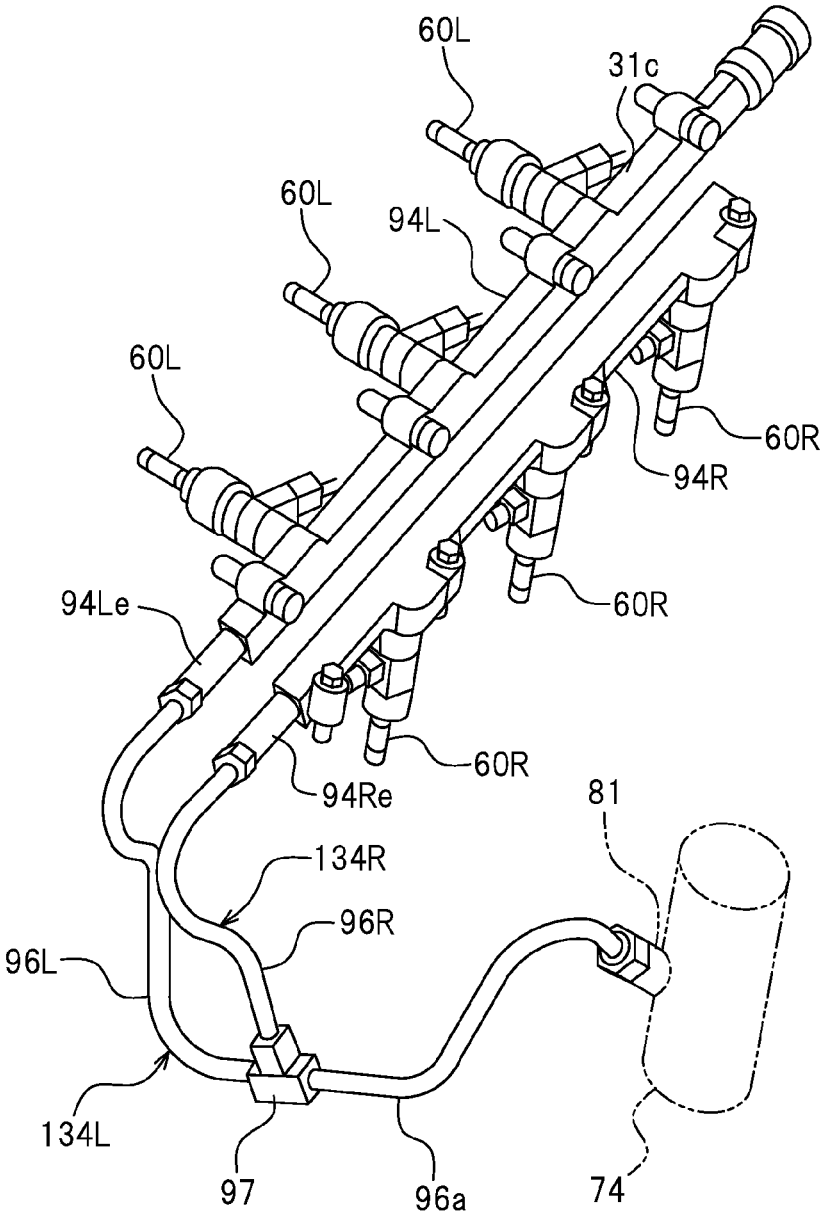

As shown in FIG. 18, the high-pressure fuel pump 74 is connected to the fuel supply rail 94L and the fuel supply rail 94R by fuel pipes 96*a*, 96L and 96R. One of two ends of the fuel pipe 96*a* is connected to the ejection section 81 of the high-pressure fuel pump 74. The other end of the fuel pipe 96*a* is connected to a three-way joint 97. The three-way joint 97 is connected to one of two ends of the fuel pipe 96L and one of two ends of the fuel pipe 96R. The other end of the fuel pipe 96L is connected to a bottom portion 94Le of the fuel supply rail 94L. The other end of the fuel pipe 96R is connected to a bottom portion 94Re of the fuel supply rail 94R.

The fuel supplied from the high-pressure fuel pump 74 passes through the fuel pipe 96*a* and is distributed into the fuel pipe 96L and the fuel pipe 96L via the three-way joint 97. The fuel in the fuel pipe 96L is supplied to the left fuel supply rail 94L. The fuel in the left fuel supply rail 94L is supplied to the fuel injection devices 60L. The fuel in the fuel pipe 96R is supplied to the right fuel supply rail 94R. The fuel in the right fuel supply rail 94R is supplied to the fuel injection devices 60R. In this manner, the fuel pipes 96*a*, 96L and 96R are supplied with the high-pressure fuel from the high-pressure fuel pump 74. Therefore, the fuel pipes 96*a*, 96L and 96R are preferably made of stainless steel or other suitable material so as to have a sufficient pressure resistance, for example. It should be noted that the material of each of the fuel pipes 96*a*, 96L and 96R is not limited to stainless steel and may be any other material having a pressure resistance.

In this manner, in the present preferred embodiment, the fuel from the high-pressure fuel pump 74 is distributed by the three-way joint 97 and then supplied to the fuel supply rails 94L and 94R. It should be noted that the structure of the fuel pipes arranged to supply fuel from the high-pressure fuel pump 74 to the fuel supply rails 94L and 94R is not limited to the above-described structure. According to another structure, for example, only one of the fuel supply rails 94L and 94R may be connected to the ejection section 81 of the high-pressure fuel pump 74 via the fuel pipes, and the fuel supply rail 94L and the fuel supply rail 94R may be connected to each other via another fuel pipe. In this case, the fuel ejected from the high-pressure fuel pump 74 is supplied via one of the fuel supply rail 94L and the fuel supply rail 94R to the other of the fuel supply rail 94L and the fuel supply rail 94R.

The fuel supplied to the fuel injection devices 60L and 60R is injected into the combustion chambers 36 by the fuel injection devices 60L and 60R. The injected fuel is mixed with the air in the combustion chambers 36 to become mixed gas. This mixed gas is ignited by the ignition plugs 61 and explodes. This explosion generates a driving force of the engine 8.

A portion of the non-combusted mixed gas (hereinafter, referred to as "blow-by gas") may pass a gap between the pistons 33 and the cylinders 32 and leak into the crankcase 27. The blow-by gas in the crankcase 27 is mixed with the lubricant in the crankcase 27 and flows outside the crankcase 27. The engine 8 according to the present preferred embodiment separates the blow-by gas from the lubricant and returns the blow-by gas to the combustion chambers 36. The engine 8 includes a gas/liquid separator 135 arranged to separate the blow-by gas from the lubricant. Now, a structure of the gas/liquid separator 135 will be described.

Figure 19:
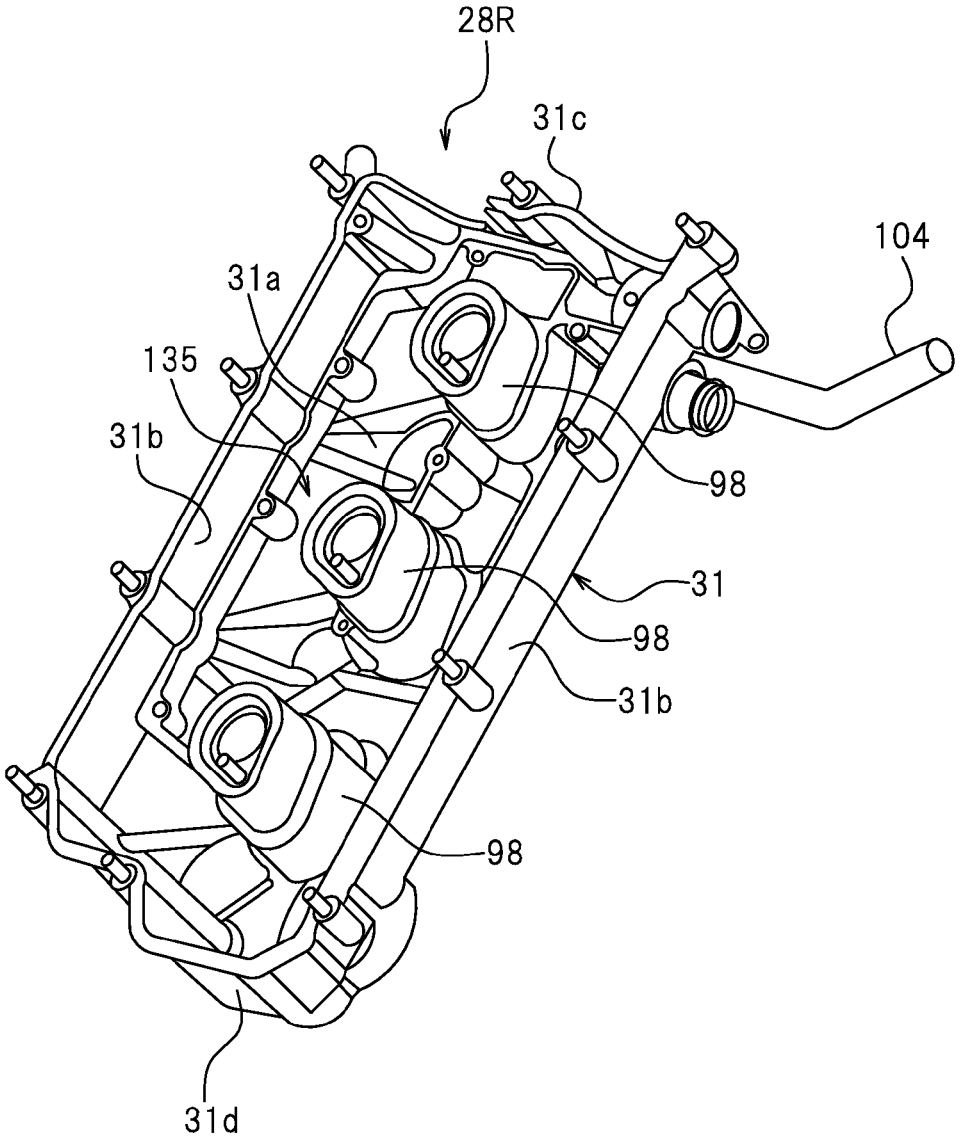
FIG. 19 is a rear surface view of a head cover in the right bank.

The gas/liquid separator 135 is provided inside the head cover 31 in the right bank 28R. FIG. 19 shows a rear surface of the head cover 31 in the right bank 28R. The rear surface of the head cover 31 is directed toward the front end of the outboard motor 1. The head cover 31 includes a rear wall 31*a*, side walls 31*b* extending rearward from side portions of the rear wall 31*a*, a top wall 31*c* extending rearward from a top portion of the rear wall 31*a*, and a bottom wall 31*d* extending rearward from a bottom portion of the rear wall 31*a*. The head cover 31 is provided with bosses 98 to which the ignition plugs 61 are attachable. The bosses 98 extend rearward in the head cover 31.

Figure 20:
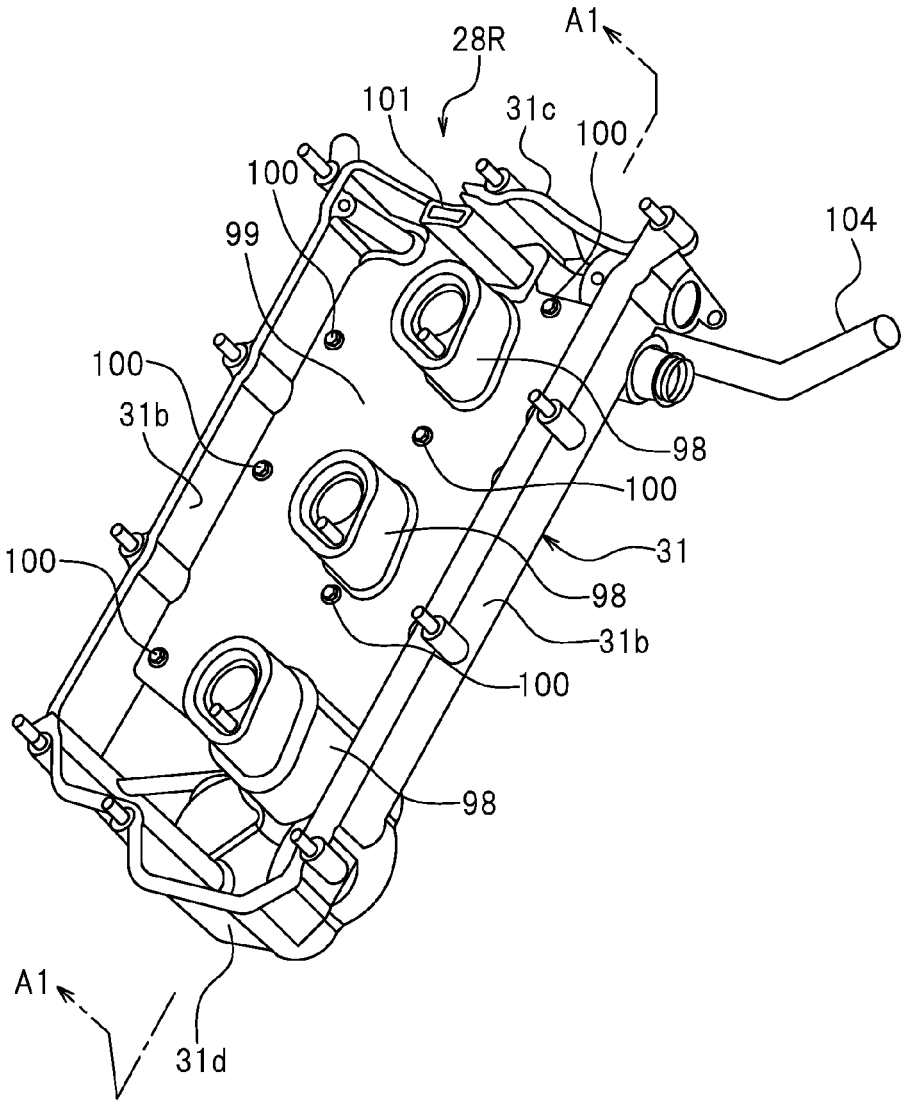
FIG. 20 is a rear surface view of a plate and a head cover in the right bank.
Figure 21:
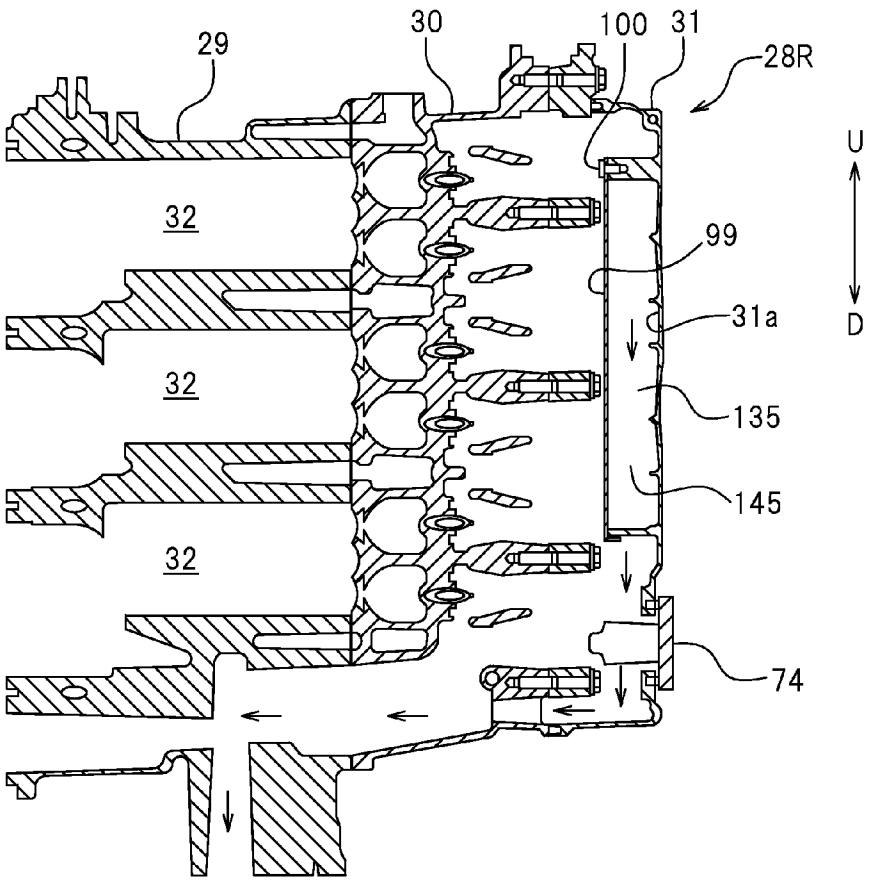
FIG. 21 is a cross-sectional view of the right bank taken along line A1-A1 in FIG. 20.

As shown in FIG. 20, inside the head cover 31, a plate 99 is arranged so as to face the rear wall 31*a* of the head cover 31. The plate 99 is secured to the head cover 31 preferably by a plurality of bolts 100, for example. However, there is no specific limitation on the method and structure for securing the plate 99 and the head cover 31 to each other. For example, in the case where the plate 99 and the head cover 31 are both preferably formed of a resin, the plate 99 may be secured to the head cover 31 by welding, for example. As shown in FIG. 21, the plate 99 is located so as to be distanced from the rear wall 31*a* of the head cover 31. Between the plate 99 and the rear wall 31*a*, a space 145 is provided. The plate 99 does not cover the bottom end portion of the rear wall 31*a*, and the space 145 is opened downward. The space 145 defines a gas/liquid separating space to separate the blow-by gas and the lubricant from each other. In this manner, the gas/liquid separator 135 is defined by the head cover 31 and the plate 99.

As shown in FIG. 20, at a top end portion of the plate 99, an flow-in section 101 is provided to introduce the blow-by gas mixed with the lubricant (hereinafter, referred to simply as the "blow-by gas"). The flow-in section 101 is structured so as to introduce the blow-by gas in the right bank 28R. In the present preferred embodiment, the flow-in section 101 includes a flat duct extending rearward in the head cover 31. In the present preferred embodiment, the duct is positioned and shaped such that the lubricant from the cams 45, 46 and the like is unlikely to flow into the duct. It should be noted that the shape of the flow-in section 101 is not limited to the above-described shape.

Figure 22:
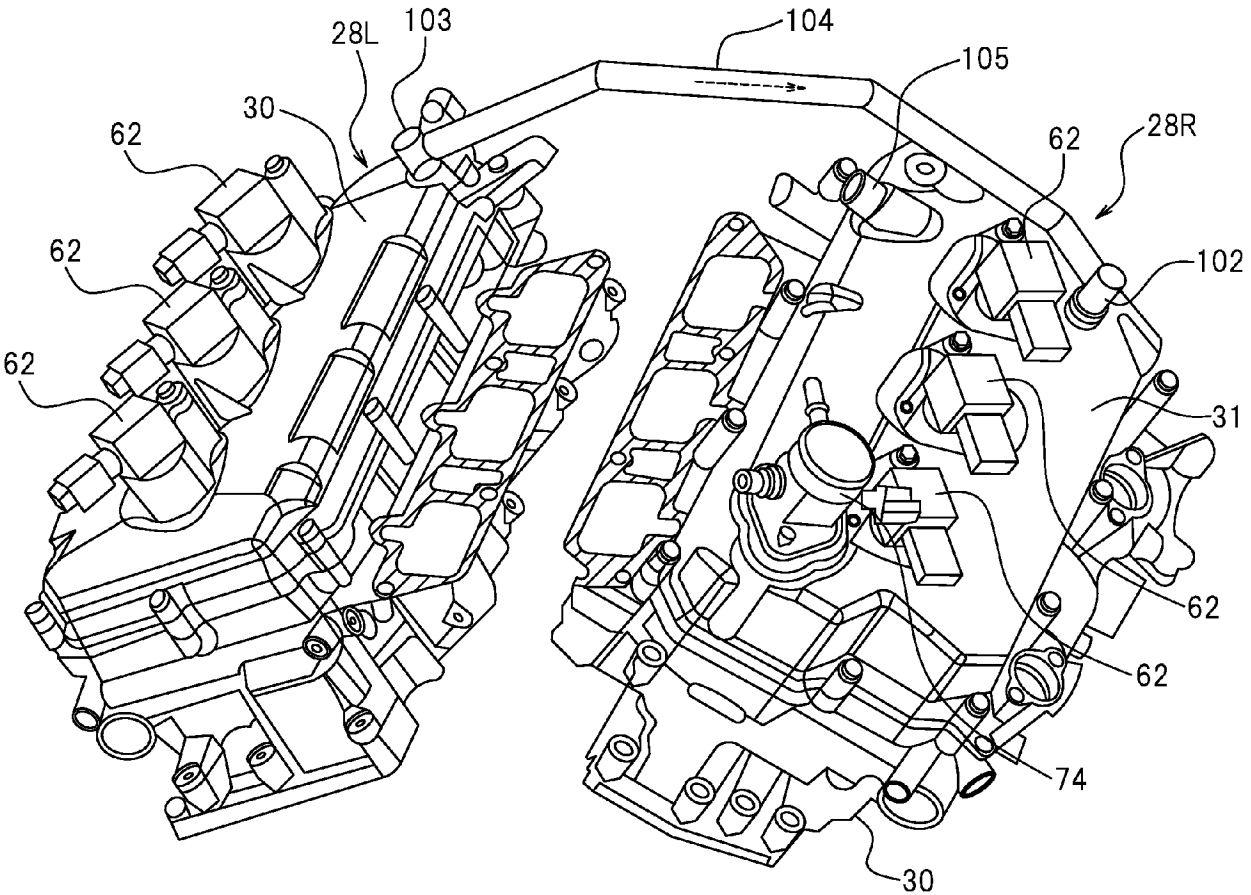
FIG. 22 is a perspective view of the head covers and the like in the left bank and in the right bank.

As shown in FIG. 22, on a front surface of the head cover 31 in the right bank 28R, another flow-in section 102 in communicate with the gas/liquid separator 135 is provided. The cylinder head 30 in the left bank 28L is provided with a flow-out section 103 arranged to discharge the blow-by gas in the left bank 28L. The flow-out section 103 and the flow-in section 102 are connected to each other by a gas pipe 104. The blow-by gas in the left bank 28L is introduced into the gas/liquid separator 135 via the flow-out section 103, the gas pipe 104 and the flow-in section 102.

As shown in FIG. 22, on the front surface of the head cover 31 in the right bank 28R, a flow-out section 105 arranged to discharge gas is provided. The flow-out section 105 is in communication with a top portion of the gas/liquid separator 135. As shown in FIG. 5, the flow-out section 105 is connected to the throttle body 50 via a gas pipe 106.

The liquid lubricant and gas have significantly different specific gravities. Therefore, when flowing into the gas/liquid separator 135, the blow-by gas mixed with the lubricant is separated into the gas having a small specific gravity and the lubricant having a large specific gravity. As shown in FIG. 21, the lubricant drops downward or flows downward on a surface of the plate 99 or the like and is collected in a bottom portion of the gas/liquid separator 135. The collected lubricant is returned to an oil reservoir (not shown) in the engine 8. The gas separated from the lubricant is sent to the throttle body 50 via the flow-out section 105 and the gas pipe 106. The gas is supplied to the combustion chambers 36, together with the air sucked from the throttle body 50, via the surge tank 48, the intake manifold 47 and the intake ports 37.

As described above, the engine 8 preferably is a water-cooled engine. The engine 8 is cooled by use of water from the sea, river, lake or the like (hereinafter, referred to as "external water") on which the watercraft 2 is traveling. Now, the cooling system for cooling the engine 8 will be described.

As shown in FIG. 1, inside the upper case 17 of the outboard motor 1, a water pump 107 arranged to transport water is provided. The water pump 107 is structured so as to be driven by the drive shaft 9. The lower case 18 includes a water intake opening 107*a* arranged to take in the external water as the cooling water. The cooling water taken in through the water intake opening 107*a* is transported to the engine 8 by the water pump 107.

Figure 23:
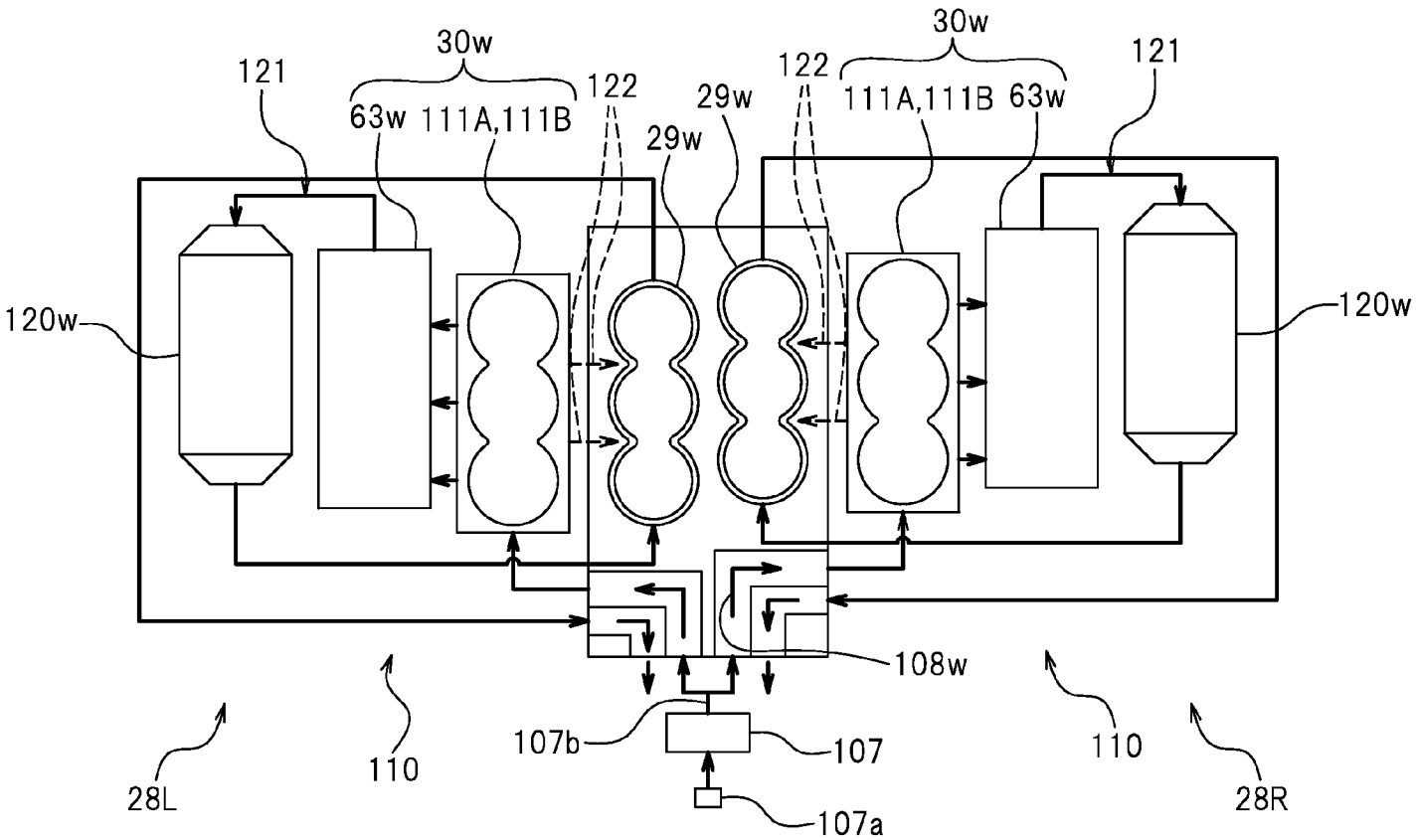
FIG. 23 is a block diagram showing a structure of a cooling system.

FIG. 23 is a block diagram showing a structure of the cooling system. The cooling system includes a cooling water path 110 in the left bank 28L and a cooling water path 110 in the right bank 28R. The cooling water path 110 in the left bank 28L and the cooling water path 110 in the right bank 28R preferably have substantially the same structure as each other. In the following, only one of the cooling water paths 110 will be described. The cooling water path 110 includes a water path 121 as a main path and a bypass path 122.

The water path 121 includes a water jacket 108*w* arranged around the exhaust gas path in the attachment block 115 of the engine 8, a water jacket 30*w* located inside the cylinder head 30, a water jacket 29*w* located inside the cylinder block 29, and a water jacket 120*w* located inside the exhaust pipe 120 (see FIG. 12). As described later in detail, the water jacket 30*w* of the cylinder head 30 includes a first jacket 111A and a second jacket 111B arranged around the combustion chambers 36 and a third jacket 63*w* arranged around the exhaust ports 38 and inside the exhaust manifold 63. The water jacket 120*w* of the exhaust pipe 120 is defined by the water jacket 66*w* of the top exhaust pipe 66 (see FIG. 12), the water jacket 65*w* of the catalyst case 65, and the water jacket 67*w* of the bottom exhaust pipe 67 which are described above.

The cooling water supplied from the water pump 107 passes through the water jacket 108*w* of the attachment block 115 of the engine 8 and flows into the first jacket 111A and the second jacket 111B of the cylinder head 30. The cooling water in the first jacket 111A and the second jacket 111B cools the cylinder head 30. A portion of the cooling water in the first jacket 111A and the second jacket 111B flows into the third jacket 63*w*. Another portion of the cooling water in the first jacket 111A and the second jacket 111B flows into the water jacket 29*w* of the cylinder block 29 via the bypass path 122. The cooling water in the third jacket 63*w* cools a portion of the cylinder 30 and also the exhaust manifold 63, and then flows into the water jacket 120*w*. The cooling water in the water jacket 120*w* cools the exhaust pipe 120. In other words, the cooling water in the water jacket 120*w* cools the exhaust gas and the catalyst 64 in the exhaust pipe 120. The cooling water which has cooled the exhaust gas and the catalyst 64 flows from the water jacket 120*w* into the water jacket 29*w* of the cylinder block 29. The cooling water in the water jacket 29*w* cools the cylinder block 29. The cooling water which has cooled the cylinder block 29 passes through a water discharge path (not shown) and is discharged outside the outboard motor 1.

Figure 24:
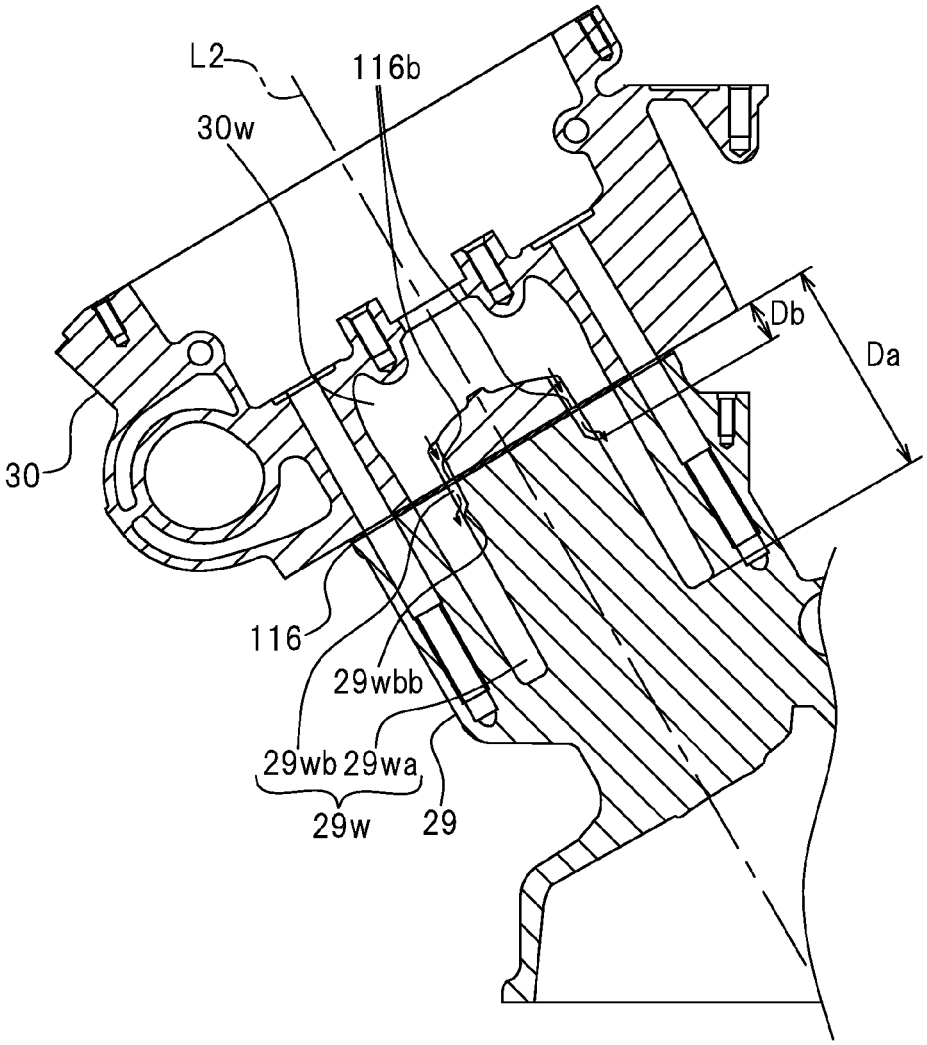
FIG. 24 is a cross-sectional view of a water jacket of a cylinder block and a water jacket of a cylinder head.
Figure 25:
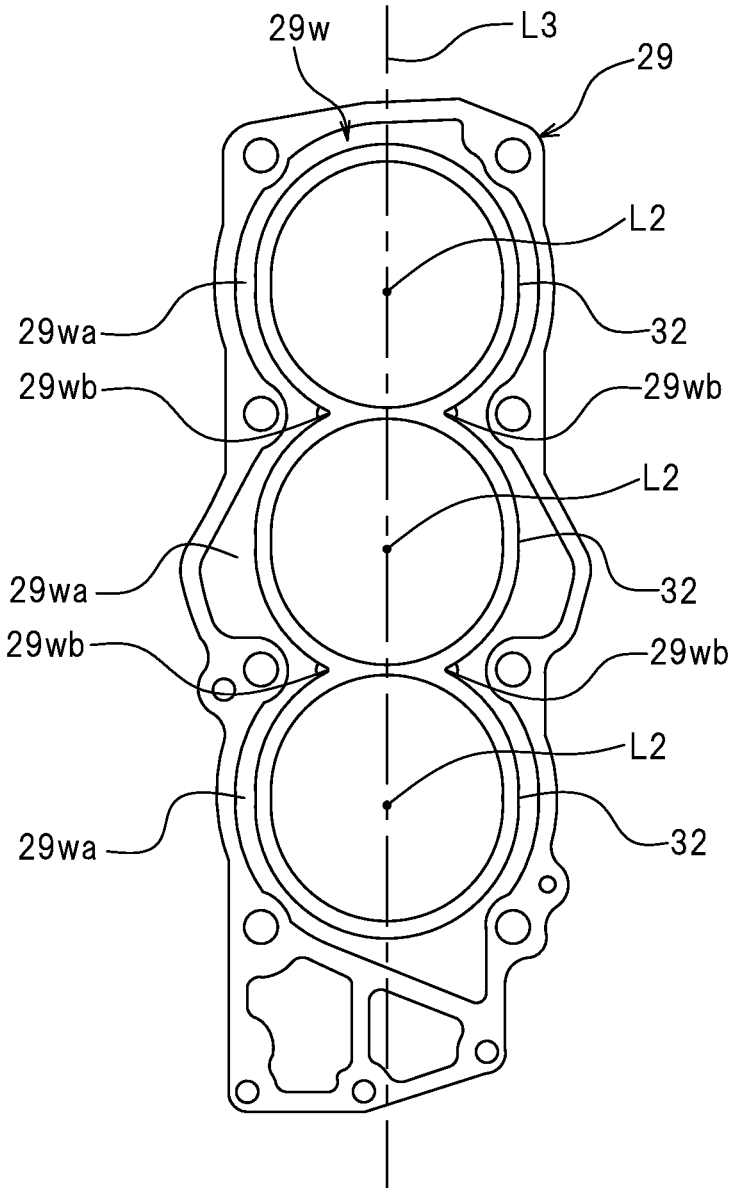
FIG. 25 is a front surface view of the cylinder block.
Figure 26:
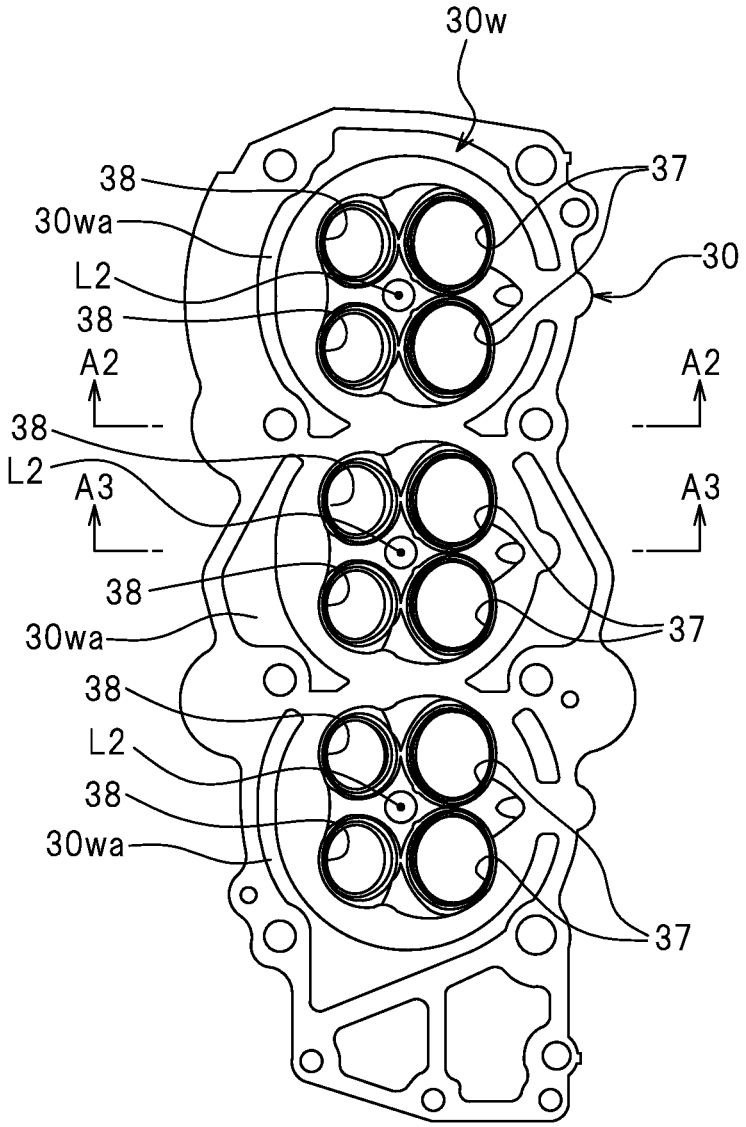
FIG. 26 is a rear surface view of the cylinder head.
Figure 27:
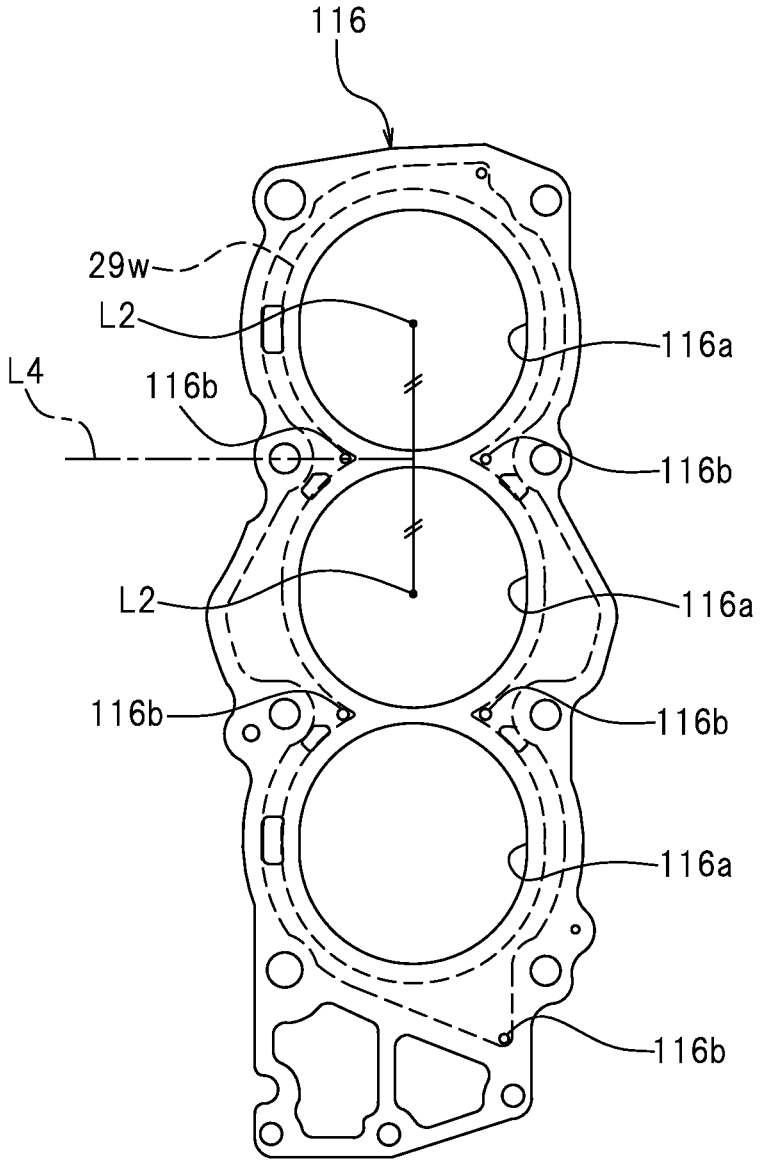
FIG. 27 is a front surface view of a gasket.

FIG. 24 is a cross-sectional view of the cylinder block 29 and the cylinder head 30. Between the cylinder block 29 and the cylinder head 30, a gasket 116 is held. FIG. 25 is a front surface view of the cylinder block 29 as seen in the direction of the cylinder axis line L2. FIG. 26 is a rear surface view of the cylinder head 30 as seen in the direction of the cylinder axis line L2. FIG. 27 is a front surface view of the gasket 116 as seen in the direction of the cylinder axis line L2. The front surface of the cylinder block 29 is directed toward the rear end of the outboard motor 1. The rear surface of the cylinder head 30 is directed toward the front end of the outboard motor 1. The front surface of the gasket 116 is directed toward the rear end of the outboard motor 1.

As shown in FIG. 25, the water jacket 29*w* of the cylinder block 29 includes generally annular grooves 29*wa* to enclose the uppermost, middle and lowermost cylinders 32, respectively. Each groove 29*wa* is arranged around the corresponding cylinder 32 and extends in an axial direction thereof. Two adjacent cylinders 32 among the cylinders 32 are linked to each other, and two adjacent grooves 29*wa* are continuous with each other. At side portions of a linking portion of the cylinders 32, cut-out grooves 29*wb* are provided. Each cut-out groove 29*wb* is recessed toward a line L3 which connects centers of the cylinders 32. As shown in FIG. 24, depth Db of the cut-out groove 29*wb* is smaller than depth Da of the groove 29*wa*. A bottom surface 29*wbb* of the cut-out groove 29*wb* is inclined.

As shown in FIG. 26, the water jacket 30*w* of the cylinder head 30 includes jacket portions 30*wa* arranged to partially enclose the uppermost, middle and lowermost combustion chambers, respectively. The jacket portions 30*wa* are in communication with each other inside the cylinder head 30. The jacket portions 30*wa* define the first jacket 111A or the second jacket 111B described above.

As shown in FIG. 27, the gasket 116 includes openings 116*a* corresponding to the cylinders 32, respectively. The gasket 116 includes holes 116*b* that guide the cooling water from the water jacket 30*w* of the cylinder head 30 to the water jacket 29*w* of the cylinder block 29. The holes 116*b* are arranged such that when the gasket 116 is held between the cylinder block 29 and the cylinder head 30, a portion of the holes 116*b* is located above the cut-out groove (s) 20*wb* of the cylinder block 29. In this example, all the holes 116*b* are preferably located above the cut-out grooves 20*wb*, for example. As shown in FIG. 24, a portion of the cooling water in the water jacket 30*w* of the cylinder head 30 flows into the cut-out grooves 29*wb* of the cylinder block 29 via the holes 116*b* and flows into the grooves 29*wa*. The bypass path 122 (see FIG. 23) for the cooling water is formed by the holes 116*b* of the gasket 116.

Figure 28:
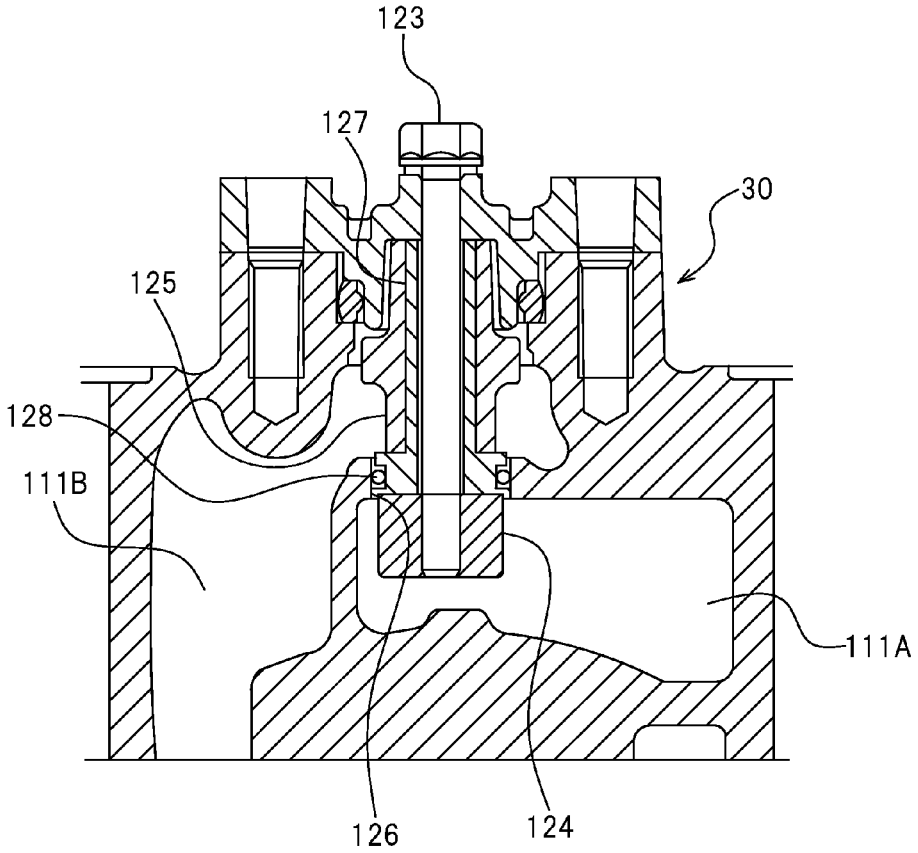
FIG. 28 is a cross-sectional view of the cylinder head taken along line A2-A2 in FIG. 26.
Figure 29:
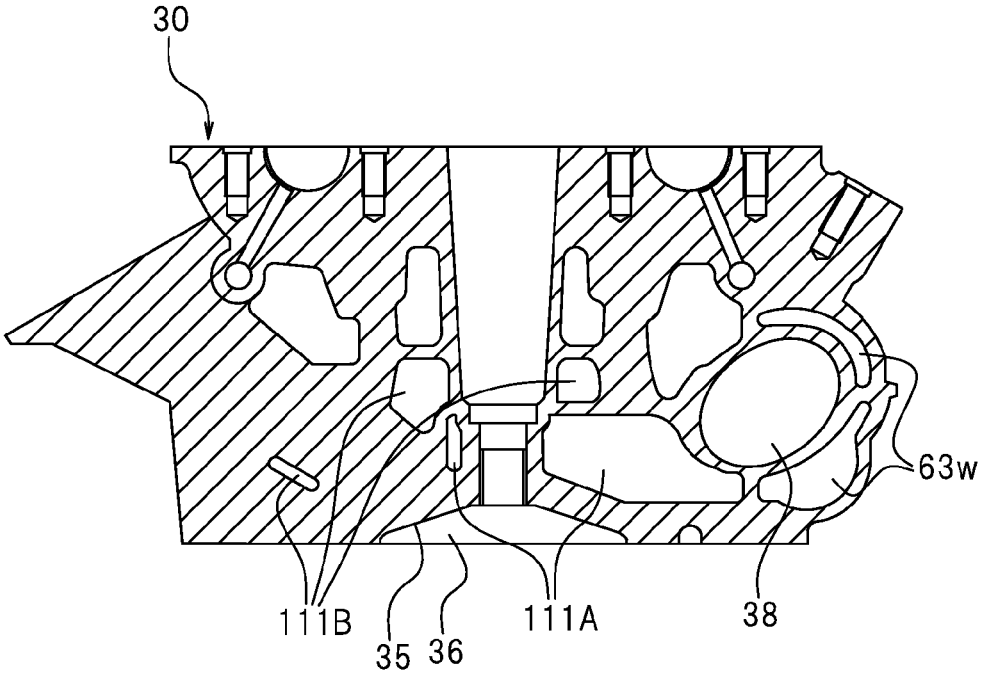
FIG. 29 is a cross-sectional view of the cylinder head taken along line A3-A3 in FIG. 26.

There is no specific limitation on the structure of the water jacket 30*w* of the cylinder head 30. As described above, in the present preferred embodiment, the water jacket 30*w* includes the first jacket 111A, the second jacket 111B, and the third jacket 63*w*. FIG. 28 is across-sectional view taken along line A2-A2 in FIG. 26. Specifically, FIG. 28 is a cross-sectional view of a portion between two adjacent cylinders 32. FIG. 29 is a cross-sectional view taken along line A3-A3 in FIG. 26. Specifically, FIG. 29 is a view of a cross-section including the cylinder axis line L2.

As shown in FIG. 29, in a cross-section including the cylinder axis line L2, the first jacket 111A is generally located below the second jacket 111B. The first jacket 111A and the first jacket 111B are generally arranged around the combustion chamber 36. The first jacket 111A and the first jacket 111B may be referred to as an "upper jacket" and a "lower jacket", respectively. Herein, the terms "upper" and "lower" simply refer to upper and lower in FIG. 29. A portion of the third jacket 63*w* is formed around the exhaust port 38.

The first jacket 111A is located relatively close to the combustion chamber 36, and the second jacket 111B is located farther from the combustion chamber 36 than the first jacket 111A is. The first jacket 111A is generally located closer to the exhaust port 38 than the second jacket 111B is. In other words, the first jacket 111A is generally located outward relative to the second jacket 111B in the outboard motor width direction. The third jacket 63*w* is located outward relative to the first jacket 111A and the second jacket 111B in the outboard motor width direction. In general, the second jacket 111B, the first jacket 111A and the third jacket 63*w* are arranged in this order from the inner side to the outer side in the outboard motor width direction. As is clear from a comparison of FIG. 28 and FIG. 29, the horizontal cross-sectional shape of each of the first jacket 111A and the second jacket 111B changes in the vertical direction. Although not shown, the horizontal cross-sectional shape of the third jacket 63*w* also changes in the vertical direction.

As described above, a portion of the third jacket 63*w* is located between the inner pipe 63*i* of the exhaust manifold 63 and an outer wall 63*o* integral with the cylinder head (see FIG. 12). Although not shown, in a side surface of the outer wall 63*o* integral with the cylinder head, a flow-in opening for the cooling water which is arranged to communicate with the second jacket 111B is provided. The cooling water is introduced into an area between the inner pipe 63*i* and the outer wall 63*o* of the exhaust manifold 63 via the flow-in opening.

As described above, the water jacket 120*w* of the exhaust pipe 120 includes the water jacket 66*w* of the top exhaust pipe 66, the water jacket 65*w* of the catalyst case 65, and the water jacket 67*w* of the bottom exhaust pipe 67 (see FIG. 12). The water jacket 120*w* of the exhaust pipe 120 is arranged so as to cause the cooling water to flow generally downward. The water jacket 65*w* of the catalyst case 65 is arranged so as to cause the cooling water to flow downward.

As shown in FIG. 12, the outer pipe 66*o* of the top exhaust pipe 66 includes an air extraction hole 66*a* arranged to extract air. The hole 66*a* is in communication with the water jacket 66*w* of the top exhaust pipe 66. The hole 66*a* is provided at a position which is located at the uppermost position of the top exhaust pipe 66 when the outboard motor 1 is kept in a horizontal posture. The hole 66*a* is located in a curved portion of the top exhaust pipe 66. Around the hole 66*a*, a nipple 117 protruding upward is provided. Although not shown, the nipple 117 is connected to a hose. Through the hole 66*a*, the air stuck in the water jacket 120*w* can be discharged. The hole 66*a* is always open.

As shown in FIG. 12, the outer pipe 67*o* of the bottom exhaust pipe 67 includes a water extraction hole 67*a* arranged to extract water. The hole 67*a* communicates with the water jacket 67*w* of the bottom exhaust pipe 67. When not used, the outboard motor 1 is largely tilted up. The hole 67*a* is provided at a position, or in the vicinity thereof, which is located at the lowermost position of the bottom exhaust pipe 67 when the outboard motor 1 is tilted up. For example, the hole 67*a* may be arranged such that, in the case where the outboard motor 1 is set to tilted up by angle α from horizontal line P when not being in use, when the outboard motor 1 is kept in a horizontal posture, the angle made by the tangential line of the portion where the hole 67*a* is located and the horizontal line is Cc as seen in a side view. In the present preferred embodiment, the catalyst case 65 is arranged so as to extend in the vertical direction when the outboard motor 1 is kept in a horizontal posture. The hole 67*a* may be formed such that when the outboard motor 1 is kept in a horizontal posture, the angle made by the tangential line of the portion where the hole 67*a* is formed and the axial line of the catalyst case 65 is 90°-α as seen in a side view.

As shown in FIG. 12, the cylinder block 29 includes a hole 118 through which the cooling water can be discharged. The hole 67*a* and the hole 118 are in communication with each other by a rubber hose 119, for example. Instead of the rubber hose 119, a hose formed of another material such as a resin or the like may preferably be used. Instead of the hose 119, a pipe formed of, for example, a metal material such as stainless steel or the like may preferably be used. It should be noted that the rubber hose 119 is flexible. Since the hose 119 having flexibility is expandable, even if the cooling water in the hose 119 is frozen, the hose 119 has no undesirable possibility of being broken. The cooling water in the water jacket 67*w* and the like can be discharged outside via the hole 67*a*, the hose 119 and the hole 118.

Figure 30:
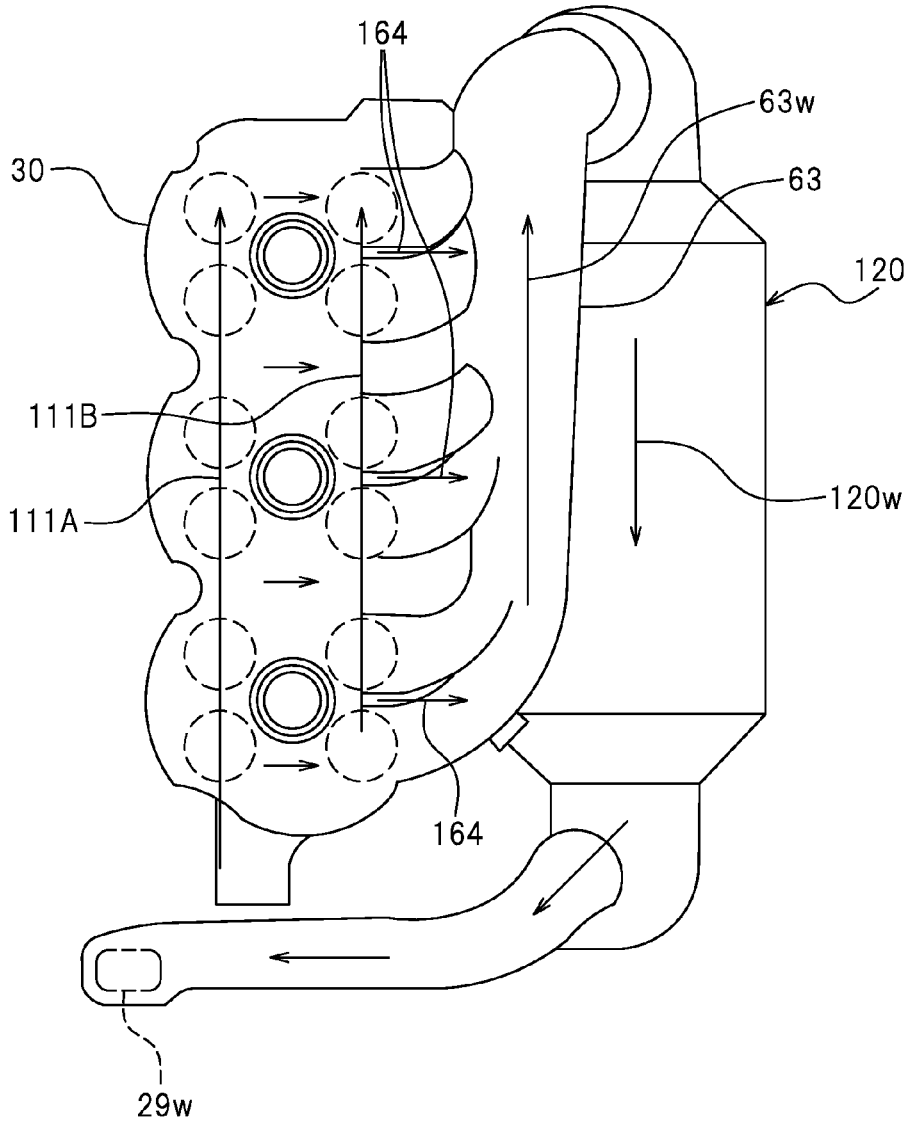
FIG. 30 is a view showing the flow of cooling water in water jackets according to a preferred embodiment of the present invention.

As described above, the cooling water which has flown into the first jacket 111A and the second jacket 111B of the cylinder head 30 partially flows into the water jacket 29*w* of the cylinder block 29 via the bypass path 122. As shown in FIG. 30, the rest of the cooling water flows upward in the first jacket 111A and the second jacket 111B while a portion thereof sequentially flows out to the third jacket 63*w* (see reference sign 164). In the third jacket 63*w*, the cooling water flows upward while being joined sequentially with the cooling water flowing in from the first jacket 111A and the second jacket 111B. The cooling water flows from the third jacket 63*w* into the water jacket 120*w* of the exhaust pipe 120, passes downward in the water jacket 120*w*, and then flows into the water jacket 29*w* of the cylinder block 29.

As shown in FIG. 28, the cylinder head 30 includes a hole 126 extending from the first jacket 111A to the second jacket 111B. A collar 127 is fit into the hole 126. A bolt 123 is preferably inserted into the collar 127. Reference sign 128 represents a ring-shaped seal. The bolt 123 extends from the first jacket 111A to the second jacket 111B. A tip portion of the bolt 123, in other words, a portion of the bolt 123 which is in the first jacket 111A is provided with a first anticorrosive electrode 124 attached thereto. A portion of the bolt 123 which is in the second jacket 111B is provided with a second anticorrosive electrode 125 attached thereto via the collar 127. The first anticorrosive electrode 124 in the first jacket 111A and the second anticorrosive electrode 125 in the second jacket 111B are attached to the same bolt 123. The expression "attached to the bolt" encompasses a state of being directly attached to the bolt 123 as in the case of the first anticorrosive electrode 124 and also a state of being attached to the bolt 123 indirectly via another member as in the case of the second anticorrosive electrode 125. The first anticorrosive electrode 124 and the second anticorrosive electrode 125 prevent the cylinder head 30 from being corroded. In the case where external water is used as the cooling water, the corrosion of the cylinder head 30 may be promoted depending on the components of the external water. Especially in the case where seawater is used as the cooling water, corrosion is likely to occur. However, according to the preferred embodiment, such corrosion can be effectively prevented by the first anticorrosive electrode 124 and the second anticorrosive electrode 125.

As shown in FIG. 6, with the outboard motor 1 according to the present preferred embodiment, the catalyst 64 is located in each of the left and right exhaust pipes 120. Therefore, the exhaust gas can be discharged outside the engine 8 after being purified by the catalyst 64. Since the exhaust gas is discharged into the water after being purified, air pollution can be significantly reduced and prevented.

The left exhaust pipe 120 is located outward relative to the crankcase 27 and the left bank 28L in the outboard motor width direction. The right exhaust pipe 120 is located outward relative to the crankcase 27 and the right bank 28R in the outboard motor width direction. By effectively using the space outward relative to the crankcase 27 and the left bank 28L in the outboard motor width direction and the space outer to the crankcase 27 and the left bank 28R in the outboard motor width direction to install the left and right exhaust pipes 120 in this manner, the size of the outboard motor 1 can be decreased.

The exhaust ports 38 in the left bank 28L and the right bank 28R are both arranged outward relative to the cylinder axis lines L2 in the outboard motor width direction. Thus, the exhaust pipes 120 can be made short. Since the space occupied by the exhaust pipes 120 can be significantly reduced, the size of the outboard motor 1 can be decreased although the outboard motor 1 includes the catalysts 64.

As shown in FIG. 6, as seen in a plan view, the outermost end 65*oe* of the catalyst case 65 in the left bank 28L in the outboard motor width direction is the left end of the left exhaust pipe 120. The outermost end 30*oe* of the cylinder head 30 in the left bank 28L in the outboard motor width direction is the left end of the cylinder head 30. As can be seen from FIG. 6, the left end of the left exhaust pipe 120 is at approximately the same position as that of the left end 30*oe* of the cylinder 30 in the left bank 28L in the left-right direction, and is not located to the left of the left end 30*oe*. Similarly, the right end of the right exhaust pipe 120 is not located to the right of the right end of the cylinder head 30 in the right bank 28R. In this manner, the left exhaust pipe 120 does not protrude outward relative to the left bank 28L in the outboard motor width direction, and the right exhaust pipe 120 does not protrude outward relative to the right bank 28L in the outboard motor width direction. Therefore, an increase in the size of the outboard motor 1 in the width direction thereof is prevented although the outboard motor 1 includes the left and right catalysts 64.

In the present preferred embodiment, the left end of the left exhaust pipe 120 preferably is at approximately the same position as that of the left end 30*oe* of the cylinder head 30 in the left bank 28L. The left end of the left exhaust pipe 120 may be located to the right of the left end 30*oe*. Similarly, the right end of the right exhaust pipe 120 may be located to the left of the right end of the cylinder head 30 in the right bank 28R.

As shown in FIG. 6, as seen in a plan view, the left and right catalysts 64 are respectively located in an area enclosed by the crankcase 27, the cylinder block 29 in the left bank 28L and a left wall 14L of the top cowl 14, and an area enclosed by the crankcase 27, the cylinder block 29 in the right bank 28R and a right wall 14R of the top cowl 14. By effectively using these areas to install the catalysts 64 in this manner, the size of the outboard motor 1 can be decreased.

Each catalyst 64 and the catalyst case 65 to cover the catalyst 64 are located at a relatively forward position. In the present preferred embodiment, the left and right catalysts 64 are located such that front ends 64*f* thereof are located forward with respect to the center 13*a* of the crankshaft 13. Therefore, as compared with the case where the catalysts 64 and the catalyst cases 65 are located at a position closer to the rear end of the outboard motor 1, the center of gravity of the outboard motor 1 can be located at a position closer to the front end thereof. As a result, the center of gravity of the outboard motor 1 is closer to the hull 3, and thus the outboard motor 1 can be handled more easily.

In the present preferred embodiment, each of the left and right catalysts 64 is located such that a center 64*c* thereof is located forward with respect to the rear end 29*b* of the cylinder block 29. Therefore, the center of gravity of the outboard motor 1 can be located at a position closer to the front end of the outboard motor 1.

In the present preferred embodiment, each of the left and right catalysts 64 is located such that the center 64*c* thereof is located rearward relative to the center 13*a* of the crankshaft 13. If the position of the catalyst 64 is too close to the front end of the outboard motor 1, the exhaust pipe 120 may be too long. However, according to the present preferred embodiment, the center of gravity of the outboard motor 1 can be located at a position close to the front end of the outboard motor 1 while the length of each of the left and right exhaust pipes 120 is made short. The catalysts 64 can be located at preferable positions.

As shown in FIG. 2, with the outboard motor 1, as seen in a plan view, the oil filter 23 is located in an area enclosed by the crankcase 27, the left exhaust pipe 120 and the left wall 14L of the top cowl 14. By effectively using this space to install the oil filter 23, the size of the outboard motor 1 can be decreased.

With the outboard motor 1, as seen in a plan view, the starter motor 24 is located in an area enclosed by the crankcase 27, the right exhaust pipe 120 and the right wall 14R of the top cowl 14. By effectively using this space to install the starter motor 24, the size of the outboard motor 1 can be decreased.

In this manner, with the outboard motor 1, as seen in a plan view, the oil filter 23 preferably is located in one of the following two areas, and the starter motor 24 preferably is located in the other of the following two areas: an area enclosed by the crankcase 27, the left exhaust pipe 120 and the left wall 14L of the top cowl 14, and an area enclosed by the crankcase 27, the right exhaust pipe 120 and the right wall 14R of the top cowl 14. By locating the oil filter 23 and the starter motor 14 in left and right areas separately, the size of the outboard motor 1 can be further decreased. The oil filter 23 and the starter motor 24 may be located oppositely. Specifically, as seen in a plan view, the oil filter 23 may be located in an area enclosed by the crankcase 27, the right exhaust pipe 120 and the right wall 14R of the top cowl 14, and the starter motor 24 may be located in an area enclosed by the crankcase 27, the left exhaust pipe 120 and the left wall 14L of the top cowl 14.

With the outboard motor 1, the fuel injection devices 60L and 60R are located rearward relative to the crankshaft 13, and the vapor separator tank 20 is located forward with respect to the crankshaft 13. Therefore, as shown in FIG. 2, a portion of the fuel path (fuel hose 78) to supply fuel form the vapor separator tank 20 to the fuel injection devices 60L and 60R needs to extend rearward. Areas to the side of the exhaust pipes 120 have a high temperature. Therefore, if the fuel path is located so as to pass an area to the side of the left exhaust pipe 120, the fuel may be excessively heated. However, according to the present preferred embodiment, as shown in FIG. 3, the fuel hose 78, which is a portion of the fuel path to supply fuel from the vapor separator tank 20 to the fuel injection devices 60L and 60R passes below the left exhaust pipe 120. Therefore, the fuel can be prevented from being excessively heated. For maintenance work to be performed on the engine 8, the exhaust pipe 120 accommodating the catalyst 64 and the like may be removed. According to the present preferred embodiment, the fuel hose 78 is located below the exhaust pipe 120, and thus does not need to be removed to perform maintenance work. This allows the maintenance work to be performed more easily. In addition, to assemble the top cowl 14 to the bottom cowl 15, interference of the fuel hose 78 and the top cowl 14 can be avoided.

Figure 31:
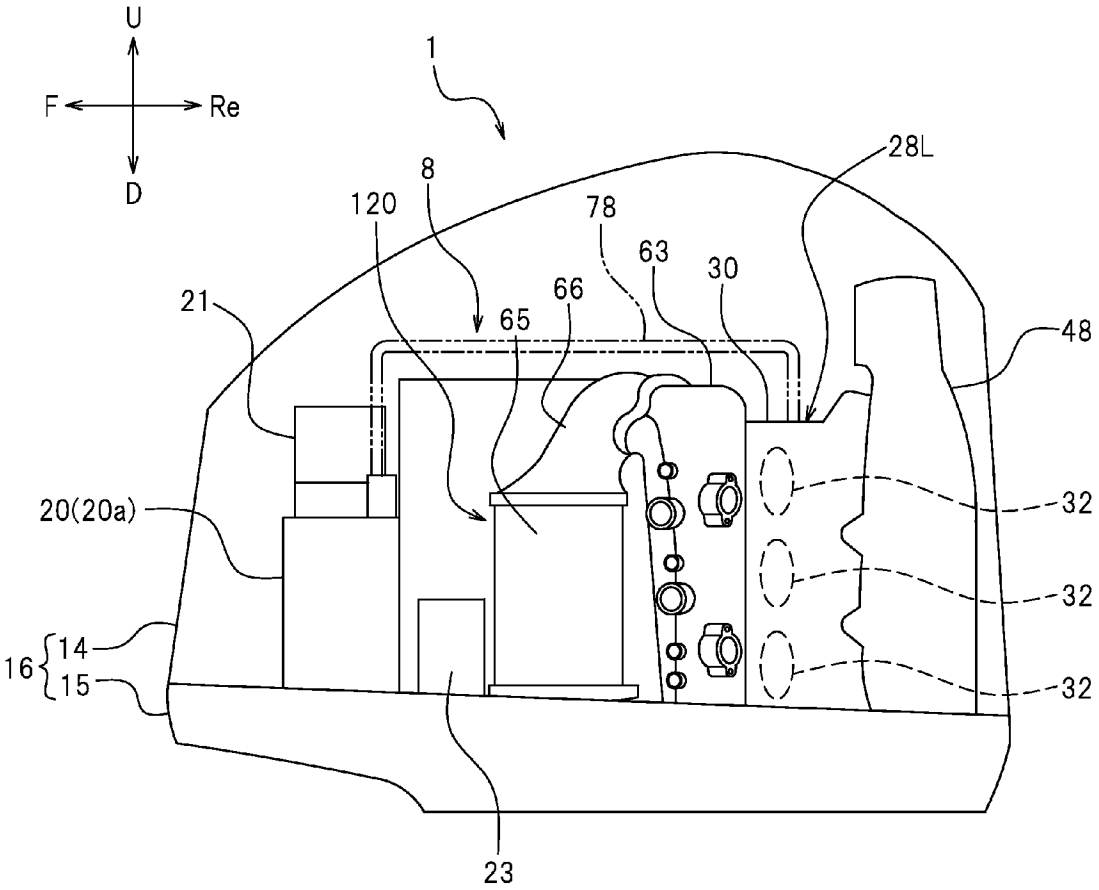
FIG. 31 is a left side view of a portion of an outboard motor according to a preferred embodiment of the present invention.

As shown in FIG. 31, the fuel hose 78 may be located so as to pass above the exhaust pipe 120. Even in this case, the fuel can be prevented from being excessively heated. In this case, the fuel hose 78 can be installed easily. The maintenance work of the fuel hose 78 is performed easily, and thus the maintenance work of the engine 8 is performed easily.

Figure 32:
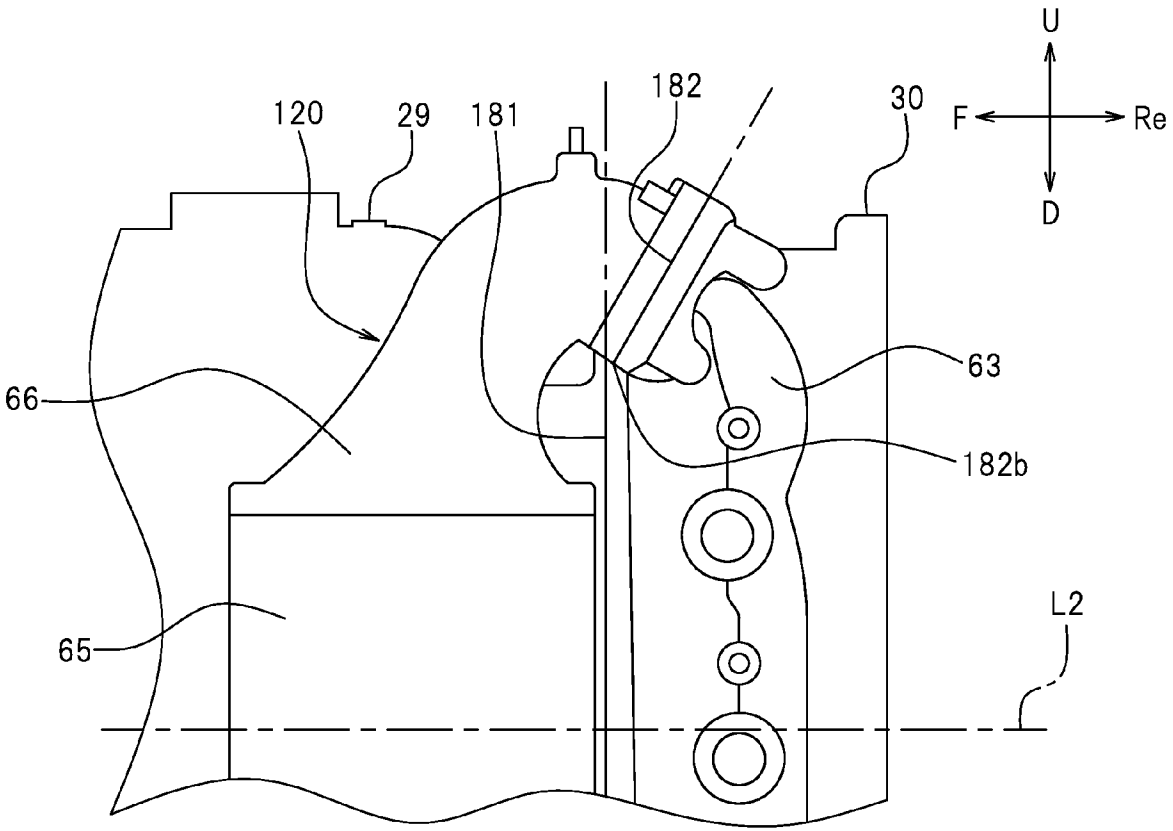
FIG. 32 is a side view of an exhaust pipe, an exhaust manifold and the like which is provided for explaining, for example, a joining face at which the exhaust pipe and the exhaust manifold are joined to each other.

As shown in FIG. 32, with the engine 8 of the outboard motor 1 according to the present preferred embodiment, each cylinder block 29 and the corresponding cylinder head 30 each include a joining surface 181 including a vertical plane perpendicular or substantially perpendicular to the cylinder axis line L2. The cylinder block 29 and the cylinder head 30 are joined to each other such that the joining surfaces 181 face each other. The top exhaust pipe 66 of each exhaust pipe 120 and the corresponding exhaust manifold 63 each include a joining surface 182 inclined with respect to the vertical plane. The top exhaust pipe 66 and the exhaust manifold 63 are joined to each other such that the joining surfaces 182 face each other. As shown in FIG. 32, when seen in a direction perpendicular to the cylinder axis line L2, the second joining surfaces 182 are inclined so as to extend rearward as going upward. A bottom end 182*b* of the second joining surfaces 182 (the bottom end is also a front end) is located rear to the first joining surfaces 181. The entirety of the second joining surfaces 182 is located rear to the first joining surfaces 181. In other words, the second joining surfaces 182 are located closer to the cylinder head 30 than the first joining surfaces 181 are.

In this manner, according to the present preferred embodiment, the exhaust manifold 63 preferably is integrally formed with the cylinder head 30, but the second joining surfaces 182 are inclined with respect to the first joining surfaces 181. Therefore, the exhaust pipe can extend longer upward.

Figure 33:
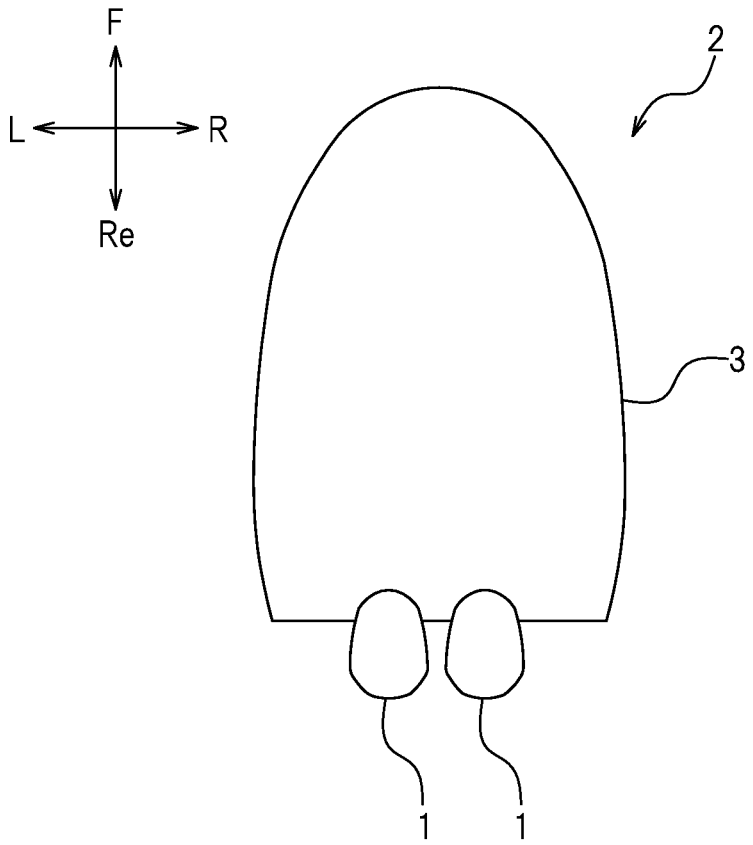
FIG. 33 is a schematic plan view of a watercraft including a plurality of outboard motors.

One outboard motor 1 according to the present preferred embodiment may be attached to the hull 3. Alternatively, as shown in FIG. 33, a plurality of outboard motors 1 may be arranged side by side in the outboard motor width direction. The outboard motors 1 according to the present preferred embodiment have a smaller width. In the case where a plurality of such outboard motors 1 are arranged side by side in the width direction, the effect of having a smaller width is conspicuously achieved. In the example in FIG. 33, two outboard motors 1 are preferably arranged side by side, for example. However, three or more outboard motors 1 preferably may be arranged side by side, for example.

In the above preferred embodiment, the exhaust pipe 120 and the cylinder block 29 preferably are separate members. Alternatively, in another preferred embodiment of the present invention, a portion of the exhaust pipe 120 may preferably be integrally formed with the cylinder block 29. The present preferred embodiment is directed to a structure in which a portion of the exhaust pipe 120 is integrated with the cylinder block 29. The rest of the structure is the same as that of the above preferred embodiment and thus will not be described.

Figure 34:
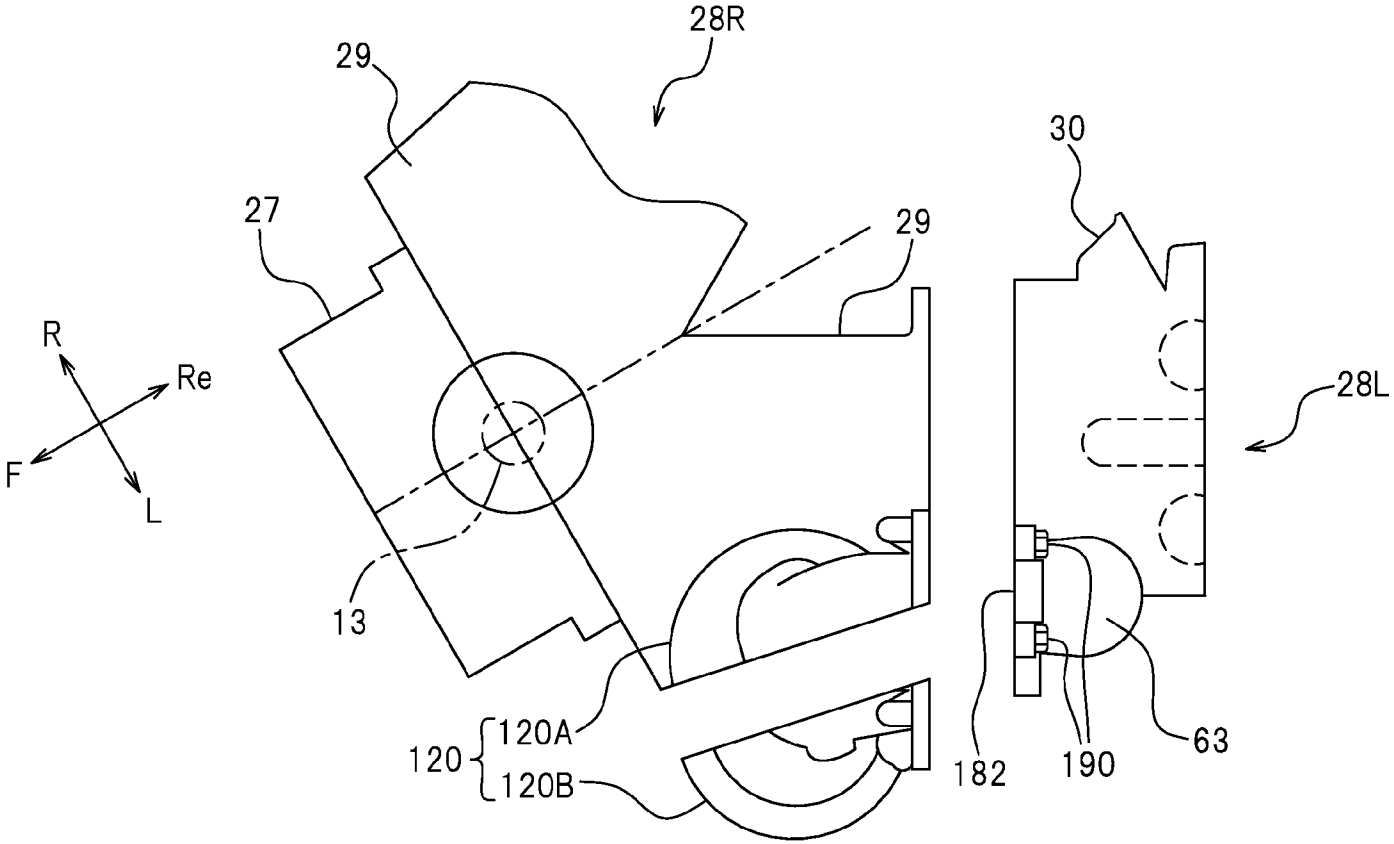
FIG. 34 is a plan view of an exhaust pipe, a cylinder block and the like according to a preferred embodiment of the present invention.

As shown in FIG. 34, in the present preferred embodiment, the exhaust pipe 120 includes a first tube forming member 120A and a second tube forming member 120B obtained as a result of dividing the exhaust pipe 120 along a cross-section including a pipe axis direction. The "cross-section including a pipe axis direction" refers to a cross-section passing the center of the tube. Although not shown, the first tube forming member 120A and the second tube forming member 120B may be obtained as a result of dividing the exhaust pipe 120 along a cross-section parallel to the pipe axis direction. The number of the tube forming members included in the exhaust pipe 120 is not limited to two, and may be three or more.

Among the top exhaust pipe 66, the catalyst case 65, and the bottom exhaust pipe 65 included in the exhaust pipe 120, one or two elements may be divided. In the present preferred embodiment, all the three elements are divided. Specifically, the first tube forming member 120A defines a portion of all of the top exhaust pipe 66, the catalyst case 65, and the bottom exhaust pipe 65. The second tube forming member 120B defines the remaining portion of all of the top exhaust pipe 66, the catalyst case 65, and the bottom exhaust pipe 65.

The first tube forming member 120A preferably is integrally formed with the cylinder block 29. In other words, the first tube forming member 120A and the cylinder block 29 are preferably provided as an integral unitary body. The first tube forming member 120A and the cylinder block 29 may be produced by, for example, casting or other suitable process. The method for producing the first tube forming member 120A and the cylinder block 29 is not limited to this.

The first tube forming member 120A and the second tube forming member 120B may be joined to each other by, for example, a bolt or other suitable joining member or method. The method for joining the first tube forming member 120A and the second tube forming member 120B is not limited to this. The exhaust manifold 63 and the first tube forming member 120A may be joined by a bolt 190 or other suitable joining member or method, and the exhaust manifold 63 and the second tube forming member 120B may be also joined by the bolt 190, for example.

As described above, according to the present preferred embodiment, the exhaust pipe 120 includes a plurality of tube forming members 120A and 120B obtained as a result of dividing the exhaust pipe 120 along a cross-section including the tube axis direction or a cross-section parallel to the tube axis direction. The first tube forming member 120A preferably is integrally formed with the cylinder block 29. Therefore, by merely joining the second tube forming member 120B to the first tube forming member 120A, the exhaust pipe 120 located to the side of the cylinder block 29 can be easily obtained. According to the present preferred embodiment, the engine 8 can be assembled easily. In the case where the catalyst case 65 is divided along a cross-section including the tube axis direction or a cross-section parallel to the tube axis direction, an advantage that the catalyst 64 can be taken out easily is provided.

Figure 35:
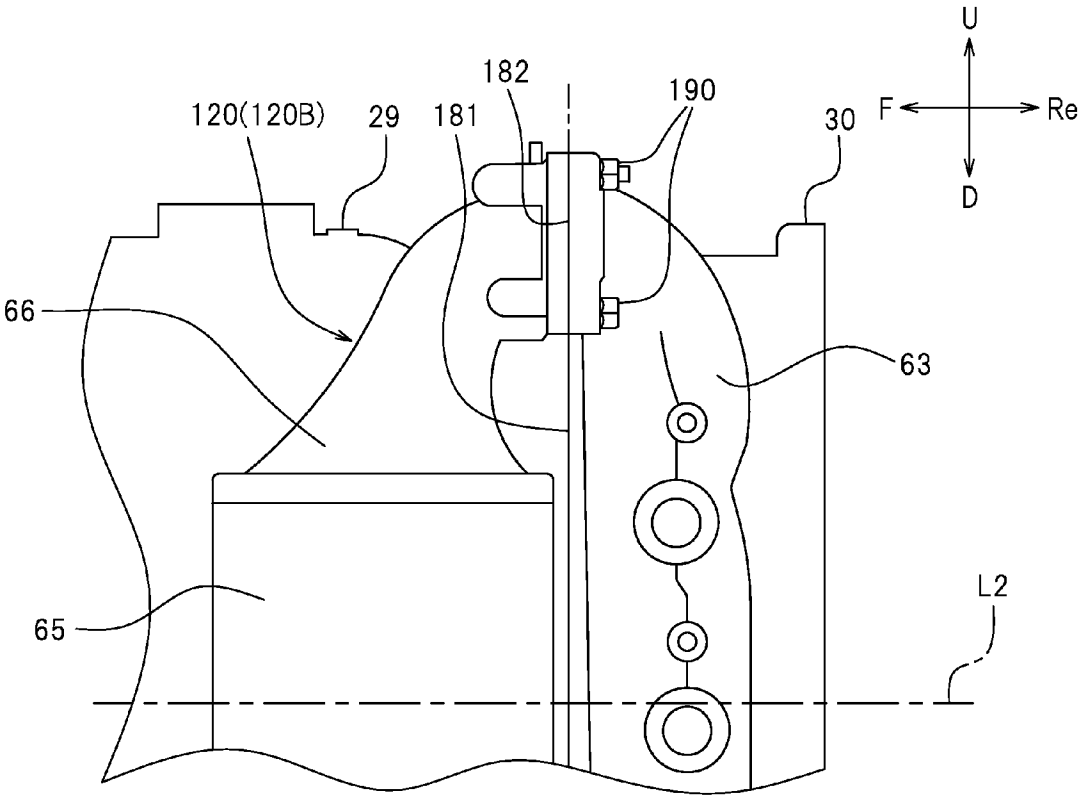
FIG. 35 is a side view of an exhaust pipe, an exhaust manifold and the like according to a preferred embodiment of the present invention.

As shown in FIG. 35, according to yet another preferred embodiment of the present invention, the cylinder block 29 and the cylinder head 30 are joined to each other along the first joining surfaces 181 including a vertical plane perpendicular or substantially perpendicular to the cylinder axis line L2. The top exhaust pipe 66 of the exhaust pipe 120 and the exhaust manifold 63 are joined to each other along the second joining surfaces 182 including a vertical plane perpendicular or substantially perpendicular to the cylinder axis line L2. As seen from a direction perpendicular or substantially perpendicular to the cylinder axis line L2, the first joining surfaces 181 and the second joining surfaces 182 appear to be generally the same as (i.e., appear to overlap) each other. According to the present preferred embodiment, as seen in the direction perpendicular or substantially perpendicular to the cylinder axis line L2, the first joining surfaces 181 and the second joining surfaces 182 appear to be generally the same as each other. Therefore, an advantage that processing and assembly are easier than in the above preferred embodiment is provided.

Figure 36:
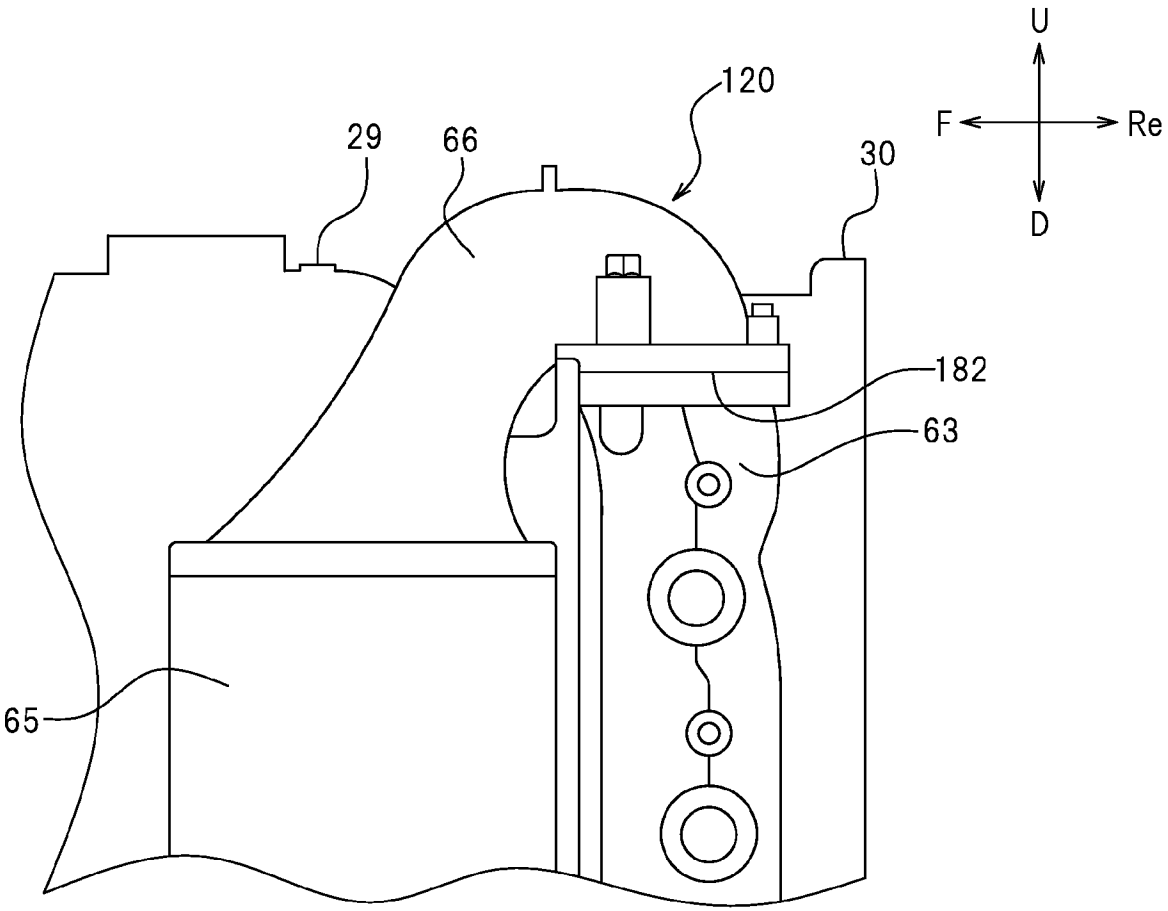
FIG. 36 is a side view of an exhaust pipe, an exhaust manifold and the like according to a preferred embodiment of the present invention.

As shown in FIG. 36, according to a further preferred embodiment of the present invention, the joining surfaces 182 of the exhaust pipe 120 and the exhaust manifold 63 are defined by a horizontal plane. In the present preferred embodiment, the top exhaust pipe 66 is preferably curved by about 180 degrees, for example. An upstream end of the top exhaust pipe 66 is directed downward. An upstream end of the exhaust manifold 63 is directed upward so as to face the upstream end of the top exhaust pipe 66. In the present preferred embodiment also, the exhaust gas flows upward in the exhaust manifold 63. The rest of the structure is the same as that of the above preferred embodiment.

According to the present preferred embodiment, the joining surfaces 182 of the exhaust pipe 120 and the exhaust manifold 63 preferably are defined by a horizontal plane. Therefore, the exhaust pipe 120 and the exhaust manifold 63 can be assembled together in the up-down direction. Thus, the processing and assembly of the exhaust pipe 120 and the exhaust manifold 63 can be performed easily. In addition, since the exhaust pipe 120 extending upward can be made long, a sufficient length of exhaust pipe can be obtained.

The length of the exhaust pipe 120 can be increased by merely elongating a portion of the exhaust pipe 120 in the vicinity of the joining surfaces 182, specifically, the upstream end portion of the top exhaust pipe 66. In this manner, the length of the exhaust pipe 120 can be changed relatively freely by a simple change of design.

The joining surfaces 182 of the exhaust pipe 120 and the exhaust manifold 63 may be vertical. Even in this case, the processing and assembly of the exhaust pipe 120 and the exhaust manifold 63 can be performed easily.

The above-mentioned "horizontal plane" and "vertical plane" are not limited to a horizontal plane and a vertical plane in a narrow sense. Planes slightly inclined with respect to the horizontal plane and the vertical plane, specifically, a substantially horizontal plane and a substantially vertical plane are encompassed in the "horizontal plane" and "vertical plane" described above.

In the above preferred embodiments, the engine 8 preferably includes the fuel injection devices 60L and 60R that directly inject fuel into the combustion chambers 36 as fuel injection devices to inject fuel. Alternatively, the engine 8 may include a fuel injection device that injects fuel into the intake ports 37 instead of, or in addition to, the fuel injection devices 60L and 60R to directly inject fuel into the combustion chambers 36.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

a V-shaped 4-cycle engine including:

a crankshaft extending in a vertical direction;

a left bank extending in an obliquely rearward and leftward direction which includes a cylinder having a cylinder axis line extending in an obliquely rearward and leftward direction; and a right bank extends in an obliquely rearward and rightward direction which includes a cylinder having a cylinder axis line extending in an obliquely rearward and rightward direction; wherein the left bank and the right bank each include:

a cylinder block including the cylinder provided therein; and a cylinder head secured to the cylinder block so as to cover the cylinder along the cylinder axis line and defining a combustion chamber together with the cylinder, the cylinder head including an intake port arranged inward relative to the cylinder axis line in an outboard motor width direction and in communication with the combustion chamber and also including an exhaust port arranged outward relative to the cylinder axis line in the outboard motor width direction and in communication with the combustion chamber; and the outboard motor further comprises:

a crankcase including the crankshaft accommodated therein;

a left exhaust path arranged outward relative to the crankcase and the left bank in the outboard motor width direction and in communication with the exhaust port in the left bank;

a right exhaust path arranged outward relative to the crankcase and the right bank in the outboard motor width direction and in communication with the exhaust port in the right bank;

a left catalyst located inside the left exhaust path; and a right catalyst located inside the right exhaust path.

2. The outboard motor according to claim 1, further comprising:

a cowling including a left wall extending in an obliquely forward and rightward direction in an area outward relative to the crankcase and the cylinder block in the left bank in the outboard motor width direction, and a right wall extending in an obliquely forward and leftward direction in an area outward relative to the crankcase and the cylinder block in the right bank in the outboard motor width direction, the cowling being arranged to cover the engine; and as seen in a plan view, the left and right catalysts are respectively located in an area enclosed by the crankcase, the cylinder block in the left bank, and the left wall, and an area enclosed by the crankcase, the cylinder block in the right bank, and the right wall.

3. The outboard motor according to claim 1, wherein, as seen in a plan view, a left end of the left exhaust path is not located to the left of a left end of the cylinder head in the left bank, and a right end of the right exhaust path is not located to the right of a right end of the cylinder head in the right bank.

4. The outboard motor according to claim 1, wherein a front end of each of the left and right catalysts is located forward with respect to a center of the crankshaft.

5. The outboard motor according to claim 1, wherein a center of each of the left and right catalysts is located forward with respect to a rear end of the corresponding cylinder block.

6. The outboard motor according to claim 4, wherein a center of each of the left and right catalysts is located rearward relative to the center of the crankshaft.

7. The outboard motor according to claim 3, further comprising an oil filter located in, as seen in a plan view, an area enclosed by the crankcase, the left exhaust path, and the left wall of the cowling or an area enclosed by the crankcase, the right exhaust path, and the right wall of the cowling.

8. The outboard motor according to claim 3, further comprising a starter motor located in, as seen in a plan view, an area enclosed by the crankcase, the left exhaust path, and the left wall of the cowling or an area enclosed by the crankcase, the right exhaust path, and the right wall of the cowling.

9. The outboard motor according to claim 3, further comprising an oil filter and a starter motor, wherein, as seen in a plan view, the oil filter and the starter motor are respectively located, or the starter motor and the oil filter are respectively located in an area enclosed by the crankcase, the left exhaust path, and the left wall of the cowling, and an area enclosed by the crankcase, the right exhaust path, and the right wall of the cowling.

10. The outboard motor according to claim 1, wherein:

the engine includes fuel injection devices that inject fuel into the combustion chambers or the intake ports, and a fuel path connected to the fuel injection devices; and a portion of the fuel path passes below the left exhaust path or the right exhaust path.

11. The outboard motor according to claim 1, wherein:

the engine includes fuel injection devices that inject fuel into the combustion chambers or the intake ports, and a fuel path connected to the fuel injection devices; and a portion of the fuel path passes above the left exhaust path or the right exhaust path.

12. The outboard motor according to claim 1, wherein the engine includes:

fuel injection devices located rearward relative to the crankshaft to inject fuel into the combustion chambers or the intake ports;

a vapor separator tank including a fuel pump to transport fuel, the vapor separator tank being located forward with respect to the crankshaft; and a fuel path arranged to connect the vapor separator tank and the fuel injection devices to each other; and a portion of the fuel path passes below the left exhaust path or the right exhaust path.

13. The outboard motor according to claim 1, wherein the engine includes:

fuel injection devices located rearward relative to the crankshaft to inject fuel into the combustion chambers or the intake ports;

a vapor separator tank including a fuel pump to transport fuel, the vapor separator tank being located forward with respect to the crankshaft; and a fuel path arranged to connect the vapor separator tank and the fuel injection devices to each other; and a portion of the fuel path passes above the left exhaust path or the right exhaust path.

14. The outboard motor according to claim 1, wherein:

the left exhaust path includes a left exhaust pipe including the left catalyst accommodated therein and the right exhaust path includes a right exhaust pipe including the right catalyst accommodated therein;

each of the exhaust pipes includes a plurality of tube forming members which are joined to each other, the plurality of tube forming members being obtained as a result of dividing the exhaust pipe along a cross-section including a tube axis direction or a cross-section parallel or substantially parallel to the tube axis direction; and at least one of the tube forming members defines an integral unitary member with the cylinder block.

15. The outboard motor according to claim 1, wherein:

the left bank and the right bank each include a plurality of sets of the cylinder, the combustion chamber, the intake port, and the exhaust port;

the cylinders in each of the left bank and the right bank are arranged in a vertical direction;

an exhaust manifold is provided in the cylinder head in each of the left bank and the right bank, in communication with the plurality of exhaust ports, and integrated with the corresponding cylinder head;

each cylinder block and the corresponding cylinder head each include a first joining surface defined by a vertical plane perpendicular or substantially perpendicular to the cylinder axis line, and the cylinder block and the cylinder head are joined to each other such that the first joining surfaces face each other;

the exhaust path includes an exhaust path which includes a second joining surface inclined with respect to a vertical plane perpendicular or substantially perpendicular to the cylinder axis line and is joined to the exhaust manifold such that the second joining surface faces the exhaust manifold; and the second joining surface is located closer to the cylinder head than the first joining surfaces are.

16. The outboard motor according to claim 1, wherein:

the left bank and the right bank each include a plurality of sets of the cylinder, the combustion chamber, the intake port, and the exhaust port;

the cylinders in each of the left bank and the right bank are arranged in a vertical direction;

an exhaust manifold is provided in the cylinder head in each of the left bank and the right bank, the exhaust manifold being arranged to communicate with the plurality of exhaust ports and causing exhaust gas to flow upward; and the exhaust path includes an exhaust pipe which includes a joining surface defined by a horizontal plane and is joined to the exhaust manifold such that the joining surface faces the exhaust manifold.

17. A watercraft comprising:

an outboard motor according to claim 1.

18. A watercraft comprising:

a plurality of the outboard motors according to claim 1, wherein the plurality of outboard motors are arranged side by side in an outboard motor width direction.

* * * * *